US009303917B2

(12) United States Patent
Park et al.

(10) Patent No.: US 9,303,917 B2
(45) Date of Patent: Apr. 5, 2016

(54) VEGETABLE CONTAINER FOR REFRIGERATORS AND REFRIGERATOR HAVING THE SAME

(71) Applicant: LG Electronics Inc., Seoul (KR)

(72) Inventors: Ahreum Park, Seoul (KR); Sanggyun Lee, Seoul (KR); Yongjoo Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 7 days.

(21) Appl. No.: 14/289,026

(22) Filed: May 28, 2014

(65) Prior Publication Data

US 2014/0354125 A1 Dec. 4, 2014

(30) Foreign Application Priority Data

May 28, 2013 (KR) ..... 10-2013-0060550
May 28, 2013 (KR) ..... 10-2013-0060551
May 28, 2013 (KR) ..... 10-2013-0060552
May 28, 2013 (KR) ..... 10-2013-0060555

(51) Int. Cl.

| | |
|---|---|
| ***F25D 25/02*** | (2006.01) |
| ***F25D 17/04*** | (2006.01) |
| ***A47B 88/04*** | (2006.01) |
| ***F25D 21/14*** | (2006.01) |
| ***F25D 23/02*** | (2006.01) |
| ***F25D 23/12*** | (2006.01) |

(52) U.S. Cl.

CPC ..... *F25D 25/025* (2013.01); *A47B 88/04* (2013.01); *F25D 17/042* (2013.01); *F25D 21/14* (2013.01); *F25D 23/028* (2013.01); *F25D 23/12* (2013.01); *F25D 2317/043* (2013.01)

(58) Field of Classification Search

CPC ..... F25D 25/025; F25D 17/042; F25D 2210/175; F25D 21/14; F25D 23/028; F25D 2317/043; F25D 17/04; F25D 17/045; F25D 17/047; A47B 2210/17; A47B 2210/175

USPC ..... 312/402, 404, 408, 296, 229, 236; 62/449

See application file for complete search history.

(56) References Cited

U.S. PATENT DOCUMENTS

| | | | | |
|---|---|---|---|---|
| 2,116,813 | A * | 5/1938 | Weisser | A23B 4/066 292/DIG. 71 |
| 3,440,308 | A * | 4/1969 | Carbary et al. | 264/45.3 |
| 4,249,392 | A * | 2/1981 | Hotta | 62/457.7 |
| 5,201,192 | A * | 4/1993 | Hara | 62/285 |
| 5,303,563 | A * | 4/1994 | Bishop et al. | 62/382 |
| 5,417,080 | A * | 5/1995 | Bishop | 62/376 |
| 6,367,276 | B1 * | 4/2002 | Kim et al. | 62/288 |

(Continued)

FOREIGN PATENT DOCUMENTS

| | | | |
|---|---|---|---|
| JP | 2005351580 | A | 12/2005 |
| KR | 19990033606 | A | 5/1999 |

(Continued)

*Primary Examiner* — Janet M Wilkens
*Assistant Examiner* — Hiwot Tefera
(74) *Attorney, Agent, or Firm* — Dentons US LLP

(57) ABSTRACT

A vegetable container for a refrigerator includes a case having an opening formed at a front thereof, the case being provided with a receiving space to receive objects to be stored, a drawer to seal an interior of the case, a discharge port formed through a bottom surface of the case to discharge water from the case, a negative pressure part to lower pressure in the case, and an opening and closing valve to open and close the discharge port.

12 Claims, 31 Drawing Sheets

(56) References Cited

U.S. PATENT DOCUMENTS

| | | | | |
|---|---|---|---|---|
| 7,810,344 | B2 * | 10/2010 | Yoon et al. | 62/338 |
| 8,443,620 | B2 * | 5/2013 | Choi et al. | 62/347 |
| 8,590,334 | B2 * | 11/2013 | Kim et al. | 62/291 |
| 8,800,820 | B2 * | 8/2014 | Girard et al. | 222/325 |
| 9,010,889 | B2 * | 4/2015 | Jung et al. | 312/404 |
| 2004/0107726 | A1 | 6/2004 | Kim et al. | |
| 2006/0277934 | A1 * | 12/2006 | Cho | 62/285 |
| 2007/0295023 | A1 * | 12/2007 | Yoon et al. | 62/338 |
| 2008/0041089 | A1 * | 2/2008 | Choi et al. | 62/344 |
| 2010/0077770 | A1 * | 4/2010 | Kamisako et al. | 62/3.6 |
| 2010/0077791 | A1 * | 4/2010 | Kamisako et al. | 62/373 |
| 2011/0126573 | A1 * | 6/2011 | Kim et al. | 62/291 |
| 2012/0104020 | A1 * | 5/2012 | Cur et al. | 222/1 |
| 2013/0340868 | A1 * | 12/2013 | Park et al. | 137/565.23 |
| 2014/0021838 | A1 * | 1/2014 | Jung et al. | 312/236 |
| 2014/0028172 | A1 * | 1/2014 | Min et al. | 312/404 |
| 2014/0354133 | A1 * | 12/2014 | Park et al. | 312/404 |

FOREIGN PATENT DOCUMENTS

| | | | |
|---|---|---|---|
| KR | 20020044402 | A | 6/2002 |
| KR | 20020044403 | A | 6/2002 |

* cited by examiner

VEGETABLE CONTAINER FOR REFRIGERATORS AND REFRIGERATOR HAVING THE SAME

CROSS-REFERENCE TO RELATED APPLICATION

This application claims the priority benefit of Korean Patent Application No. 2013-00060550, No. 2013-0060551, No. 2013-00060552 and No. 2013-00060555, filed on May 28, 2013 in the Korean Intellectual Property Office, the disclosure of which is incorporated herein by reference.

BACKGROUND

1. Field of the Disclosure

The present disclosure relates to a vegetable container for refrigerators and a refrigerator having the same.

2. Background

In general, a refrigerator is an apparatus that stores objects to be stored in a fresh state for a long period of time using cool air supplied into a storage compartment. The cool air supplied into the storage compartment is generated through heat exchange of a refrigerant. The cool air supplied into the storage compartment is uniformly distributed in the storage compartment by convection to store foods at desired temperature.

The storage compartment is defined in a main body forming the external appearance of the refrigerator. The storage compartment is open at the front thereof such that foods can be received through the opening. A door to open and close the storage compartment is mounted at the front of the storage compartment. The door is hinged to the main body to open and close the storage compartment.

The refrigerator is generally provided with a vegetable container to store vegetables. In a case in which vegetables are stored in the refrigerator, it is necessary to keep the vegetables as fresh as possible. For this reason, it is important to maintain a space in which the vegetables are received under optimal conditions.

FIG. 29 is a perspective view showing a related art vegetable container 1000 for refrigerators.

The related art vegetable container 1000 includes a case 1100 and a drawer 1300.

In a case in which the related art vegetable container 1000 is configured to have a two-box type structure, the drawer 1300 is inserted into the case 1100 in a drawer fashion. As a result, the interior of the vegetable container 1000 is hermetically sealed such that the interior of the vegetable container 1000 is in a low vacuum state to improve freshness of the vegetables stored in the vegetable container 1000.

In the related art two-box type structure, the drawer 1300 hermetically seals the interior of the vegetable container 1000 such that foods can be stored in the vegetable container 1000 in a fresh state for a long period of time. A vacuum pump is mounted in the hermetical sealing drawer 1300 or the vegetable container 1000 to uniformly maintain vacuum in the vegetable container 1000 such that foods can be stored in the vegetable container 1000 in a fresh state for a long period of time.

In this case, however, an opening of the case 1100, through which the drawer 1300 is inserted into the case 1100, may become deformed toward the interior of the case 1100 due to the difference in pressure between the inside and the outside of the case 1100.

In a case in which the case 1100 is deformed, hermetical sealing between the drawer 1300 and the case 1100 may be released with the result that external air may be introduced into the case 1100 and, therefore, the low vacuum state in the case 1100 may be released.

In addition, when temperature in the case 1100 is lowered, dew may be formed in the case 1100.

The dew formed in the case 1100 may stay on the inner surface of the case 1100 with the result that the dew may be observed by the naked eye.

Furthermore, in a case in which the dew formed in the case 1100 drops and contacts foods stored in the vegetable container 1000, the food may be softened.

In addition, the dew formed in the case 1100 may not be discharged out of the case 1100 and accumulate.

SUMMARY

One object is to provide a vegetable container for refrigerators configured such that the interior of the vegetable container can be maintained in a low vacuum state and a refrigerator having the same.

Another object is to provide a vegetable container for refrigerators configured such that dew formed in the vegetable container cannot be observed by the naked eye, the dew being guided to a water collection part, and a refrigerator having the same.

A further object is to provide a vegetable container for refrigerators configured such that dew formed in the vegetable container can be easily discharged and the interior of the vegetable container can be maintained in a low vacuum state and a refrigerator having the same.

BRIEF DESCRIPTION OF THE DRAWINGS

The above and other objects, features and other advantages may be more clearly understood from the following detailed description taken in conjunction with the accompanying drawings, in which.

DETAILED DESCRIPTION OF THE PREFERRED EMBODIMENTS

Figure 1:
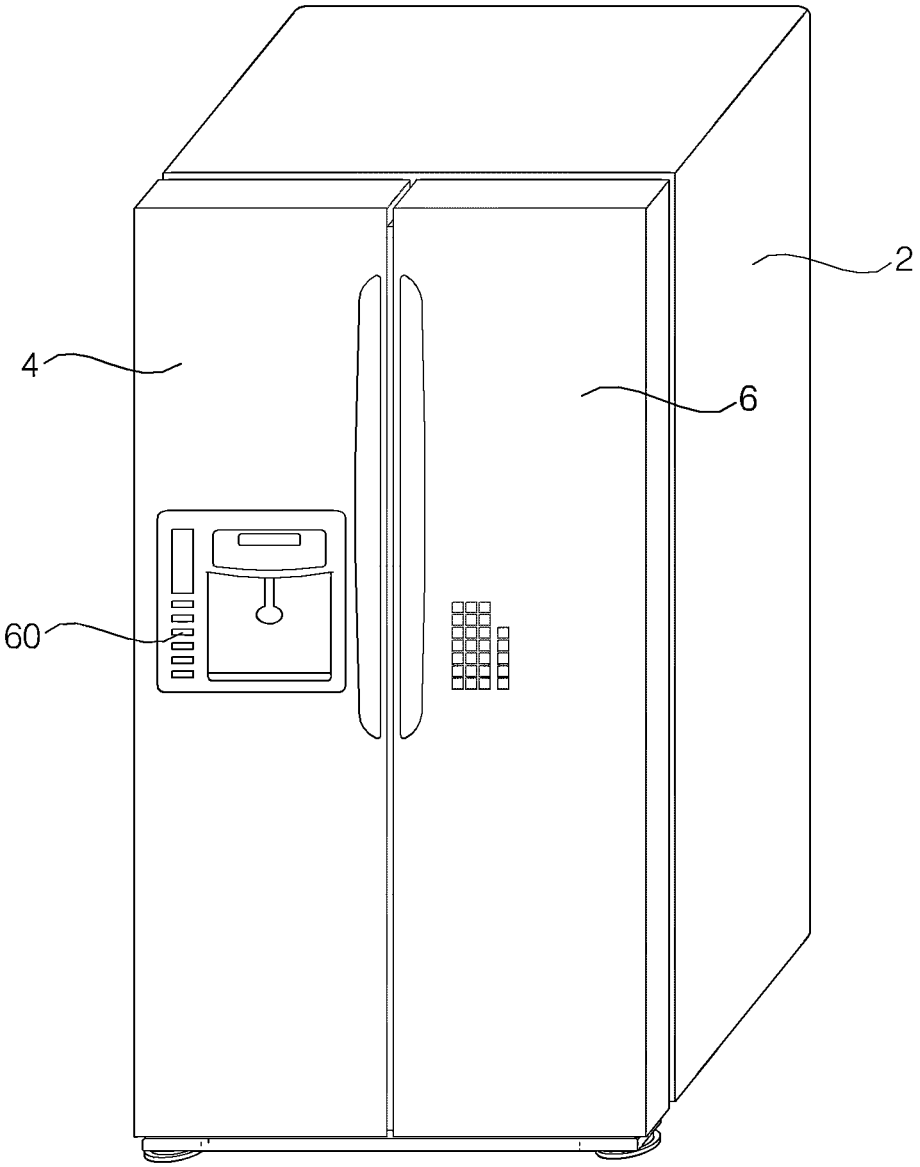
FIG. 1 is a perspective view showing a refrigerator according to an embodiment of the present invention.

Advantages and features of the present disclosure and a method of achieving the same will be more clearly understood from embodiments described below with reference to the accompanying drawings. However, the present invention is not limited to the following embodiments but may be implemented in various different forms. The embodiments are provided merely to complete disclosure and to fully provide a person having ordinary skill in the art to which the present invention pertains to practice according to the category of the invention. Wherever possible, the same reference numbers may be used throughout the specification to refer to the same or like elements.

Spatially relative terms such as "below," "beneath," "lower," "above," or "upper" may be used herein to describe one element's relationship to another element as illustrated in the drawings. It will be understood that spatially relative terms are intended to encompass different orientations of the elements during use or operation of the elements in addition to the orientation depicted in the drawings. For example, if the elements in one of the drawings are turned over, elements described as "below" or "beneath" other elements would then be oriented "above" the other elements. The exemplary terms "below" or "beneath" can, therefore, encompass both an orientation of above and below. Since the elements may be oriented in another direction, the spatially relative terms may be interpreted in accordance with the orientation of the elements.

The terminology used in this specification is for the purpose of describing particular embodiments only and is not intended to limit the present invention. As used in this specification, the singular forms are intended to include the plural forms as well unless context clearly indicates otherwise. It will be further understood that the terms "comprises" and/or "comprising," when used in this specification, specify the presence of stated elements, steps, and/or operations, but do not preclude the presence or addition of one or more other elements, steps, and/or operations.

Unless otherwise defined, all terms (including technical and scientific terms) used in this specification have the same meaning as commonly understood by a person having ordinary skill in the art to which the present invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each element may be exaggerated, omitted, or schematically illustrated for convenience of description and clarity. Also, the size or area of each element may not entirely reflect the actual size thereof.

In addition, angles or directions used to describe the structures of embodiments of the present invention are based on those shown in the drawings. Unless there is, in this specification, no definition of a reference point to describe angular positional relations in the structures of embodiments of the present invention, the associated drawings may be referred to.

Hereinafter, reference will now be made in detail to embodiments, examples of which are illustrated in the accompanying drawings.

Figure 2:
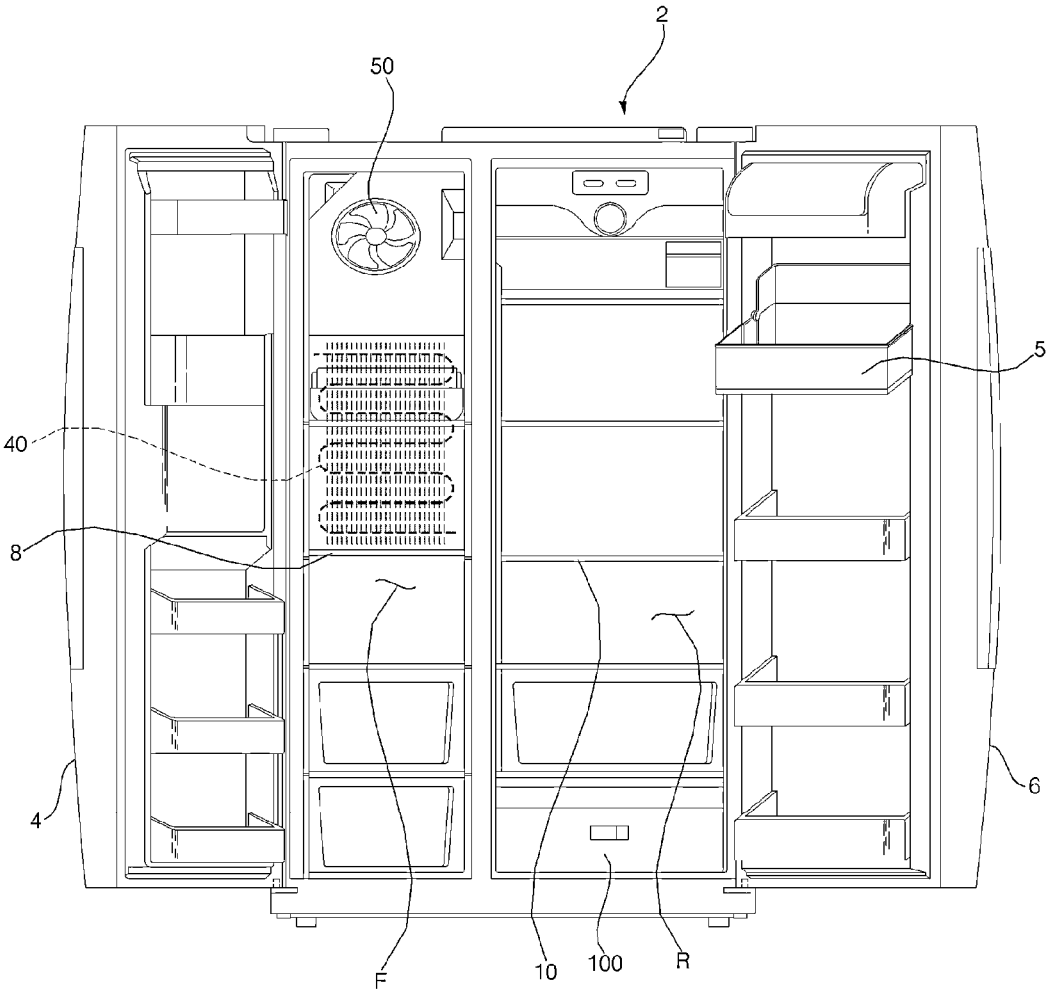
FIG. 2 is a front view showing a state in which doors of the refrigerator shown in FIG. 1 are open.

FIG. 1 is a perspective view showing a refrigerator according to an embodiment of the present invention and FIG. 2 is a front view showing a state in which doors of the refrigerator shown in FIG. 1 are open.

As shown in FIGS. 1 and 2, the refrigerator according to the embodiment of the present invention includes a main body 2 having storage compartments F and R defined therein, a cooling device 40 to cool the storage compartments F and R, and doors 4 and 6 to open and close the storage compartments F and R, respectively.

The cooling device 40 exchange heat with the outside to cool the storage compartments F and R. The cooling device 40 may be constituted by a refrigeration cycle device including a compressor, a condenser, an expansion device, and an evaporator. Alternatively, the cooling device 40 may be constituted by a thermoelectric element including first and second different metals spaced apart from each other such that one of the first and second metals absorbs heat and the other of the first and second metals emits heat. Hereinafter, the cooling device 40 will be described as being constituted by the refrigeration cycle device.

The cooling device 40 circulates a refrigerant in order of the compressor->the condenser->the expansion device->the evaporator->the compressor to cool the storage compartments F and R.

The evaporator of the cooling device 40 may be disposed in contact with the outer walls of the storage compartments F and R to directly cool the storage compartments F and R. Alternatively, the cooling device 40 may further include a cool air circulation fan 50 to circulate air in the storage compartments F and R through the evaporator and the storage compartments F and R such that the air in the storage compartments F and R can cool the storage compartments F and R while circulating through the storage compartments F and R and the evaporator.

In the storage compartments F and R of the main body 2, there may be disposed shelves 8 and 10, on which objects, such as foodstuffs and side dishes, to be stored are placed.

In addition, a vegetable container 100 to store vegetables and fruits may be mounted in the storage compartments F and R of the main body 2.

The vegetable container 100 may be mounted in the storage compartments F and R such that the vegetable container 100 can be withdrawn from the storage compartments F and R. Alternatively, the vegetable container 100 may be fixedly mounted in the storage compartments F and R.

The doors 4 and 6 are mounted at the main body 2 such that the doors 4 and 6 can be hinged in the left and right direction or in the upward and downward direction. A door basket 5 to store drinks such as spring water, milk, juice, and alcoholic beverages or ice such as ice cream is disposed at the side (i.e., the rear) of the doors 4 and 6 which faces the storage compartments F and R when the doors 4 and 6 are closed.

A plurality of door baskets 5 may be mounted at the doors 4 and 6 such that the door baskets 5 are vertically spaced apart from each other.

The storage compartments F and R may include a freezing compartment F and a refrigerating compartment R. The doors 4 and 6 include a freezing compartment door 4 to open and close the freezing compartment F and a refrigerating compartment door 6 to open and close the refrigerating compartment R. The shelves 8 and 10 may include a freezing compartment shelf 8 disposed in the freezing compartment F and a refrigerating compartment shelf 10 disposed in the refrigerating compartment R. The door basket 5 may be mounted in the freezing compartment F to store objects, such as ice cream, to be frozen or in the refrigerating compartment R to store objects, such as milk, juice, and alcoholic beverages, to be refrigerated.

Hereinafter, the vegetable container 100 will be described in detail with reference to the accompanying drawings.

Figure 3:
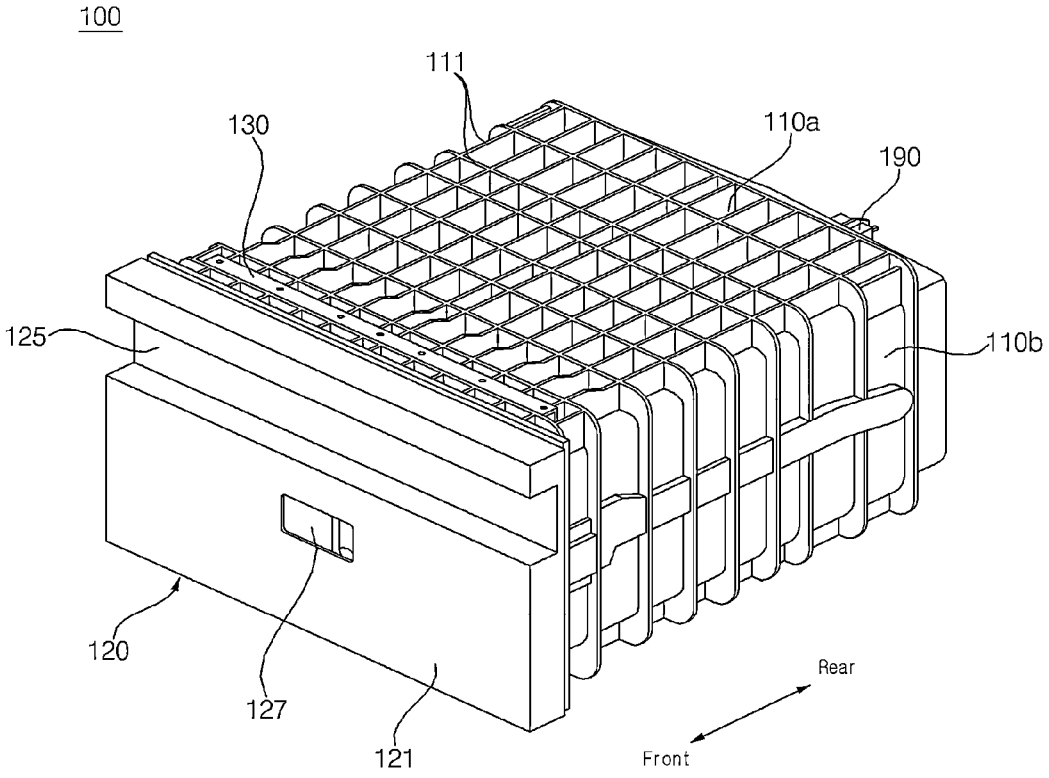
FIG. 3 is a perspective view showing a vegetable container for refrigerators according to an embodiment of the present invention.
Figure 4:
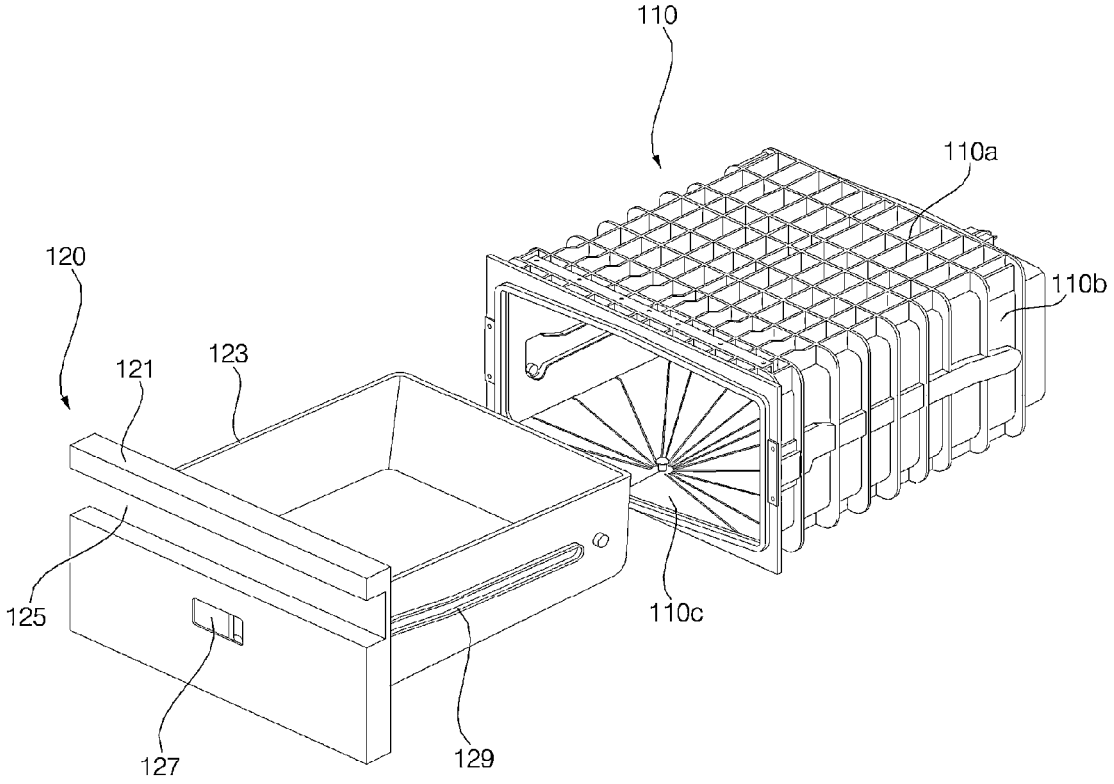
FIG. 4 is a perspective view showing a state in which the vegetable container according to the embodiment of the present invention is open.
Figure 5:
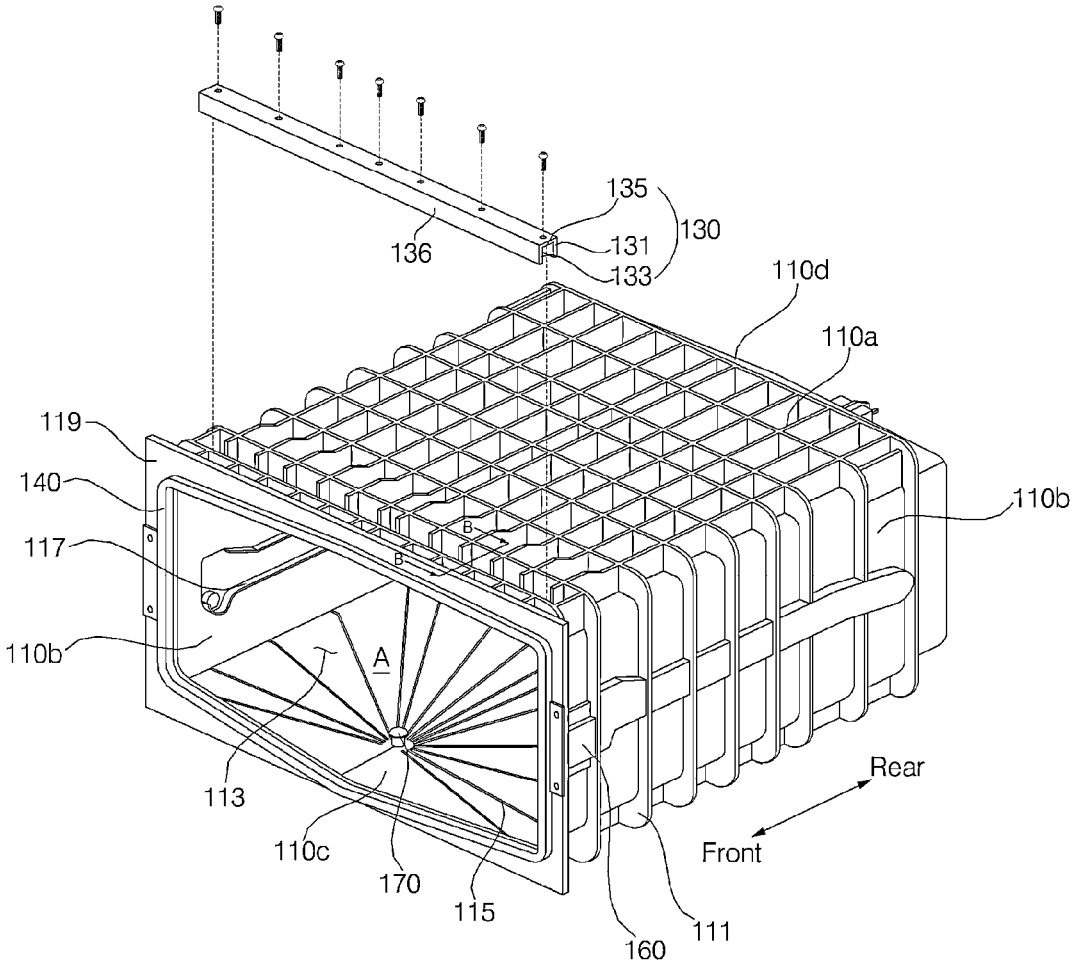
FIG. 5 is a perspective view showing a case according to an embodiment of the present invention.
Figure 6:
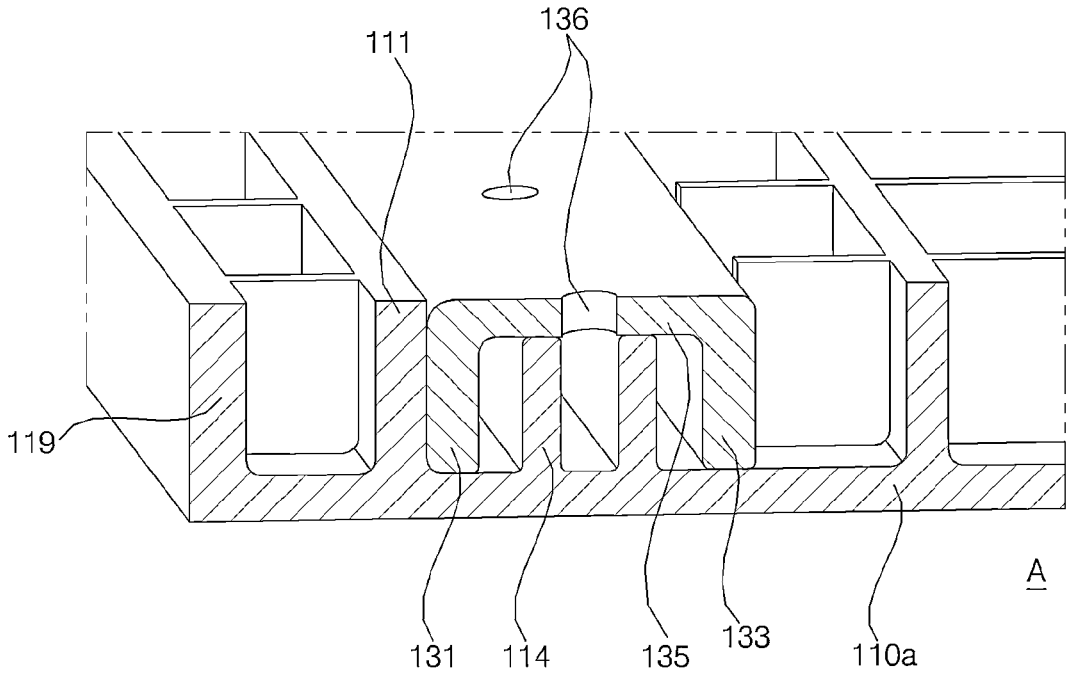
FIG. 6 is a perspective view showing a state in which a reinforcing member is coupled to the case according to the embodiment of the present invention.
Figure 7:
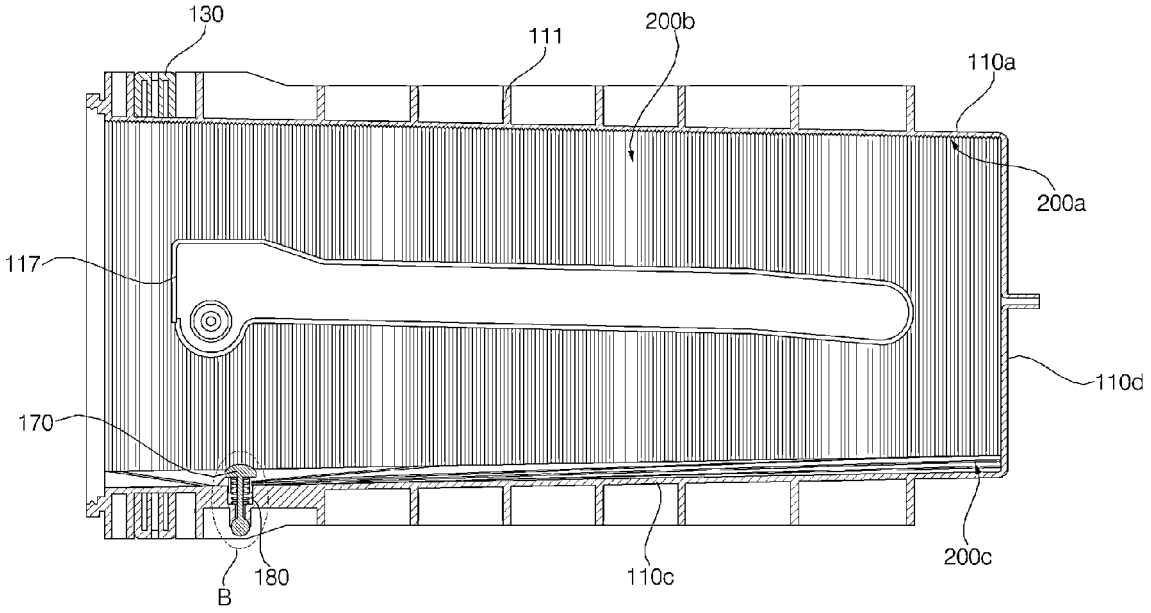
FIG. 7 is a side sectional view of the case according to the embodiment of the present invention.
Figure 8:
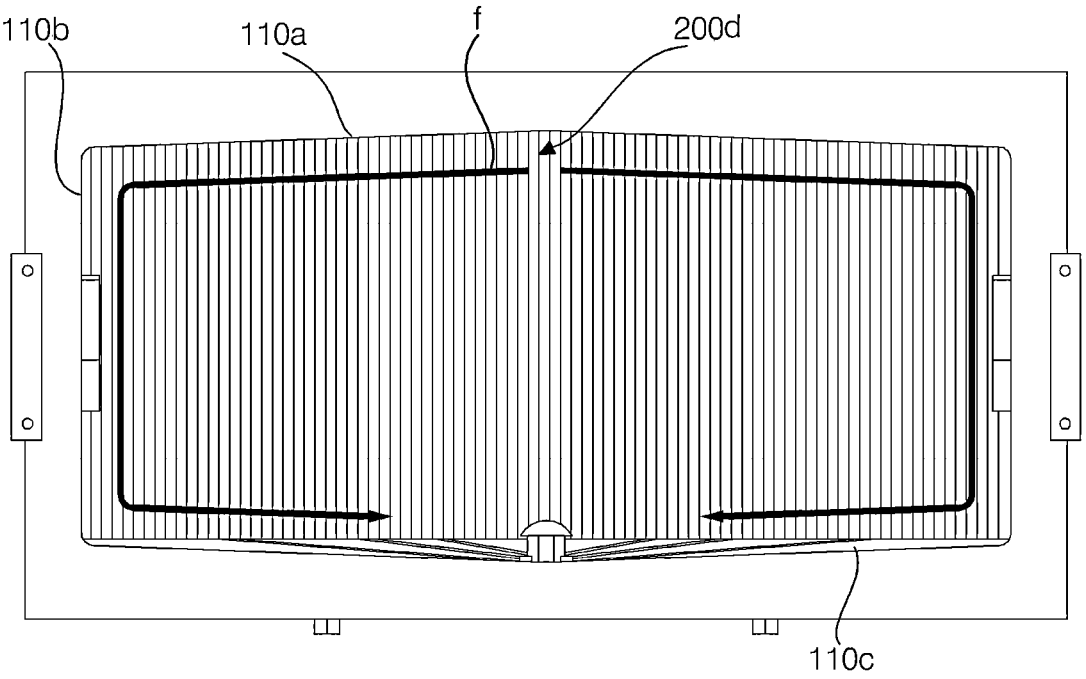
FIG. 8 is a front view of the case according to the embodiment of the present invention.
Figure 9A:
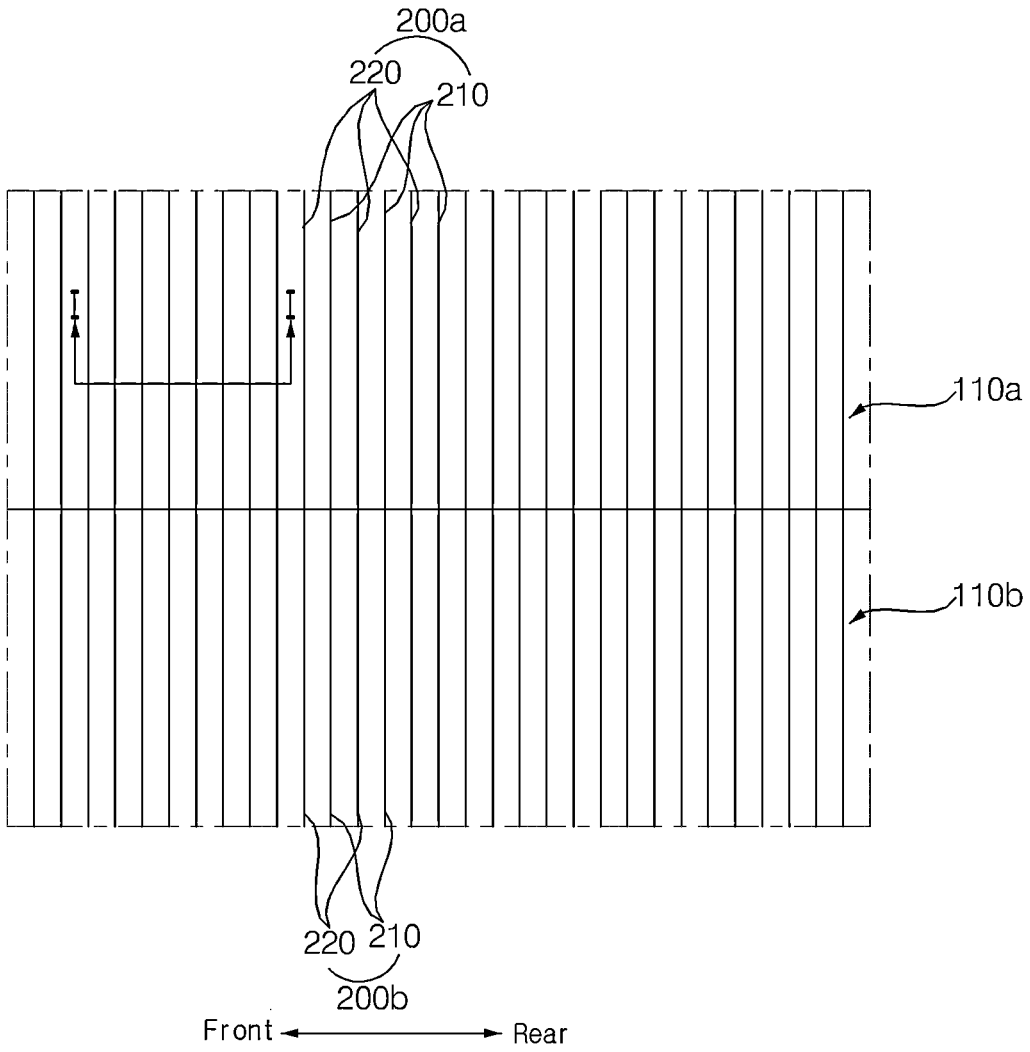
FIG. 9A is a partial plan view showing the top surface and the lateral surfaces of the case according to the embodiment of the present invention.
Figure 9B:
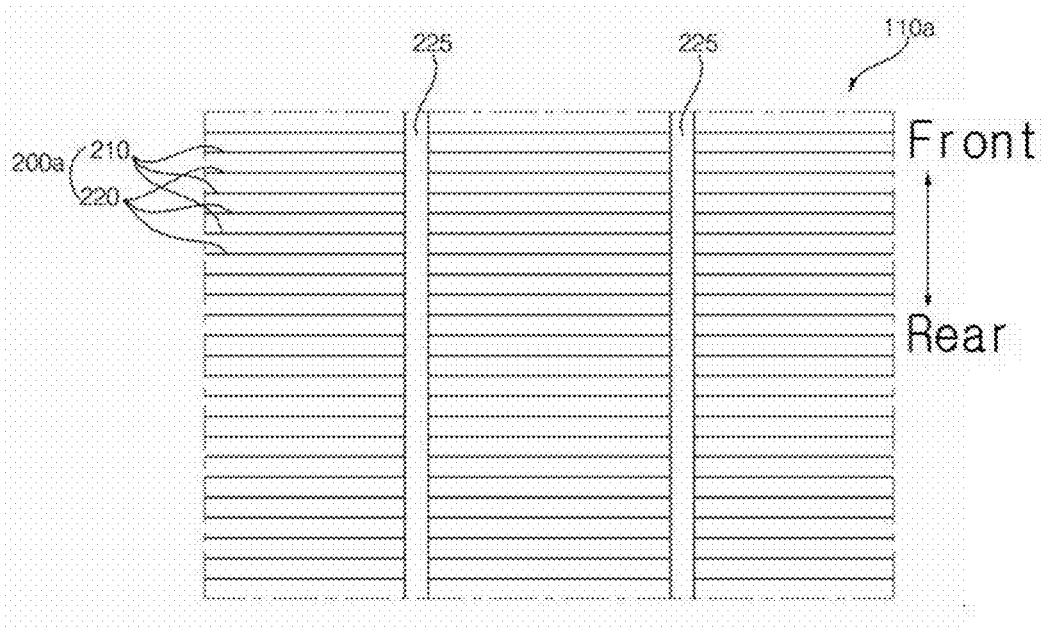
FIG. 9B is a partial plan view of the top surface of the case according to the embodiment of the present invention when viewed from the interior of the case.
Figure 9C:
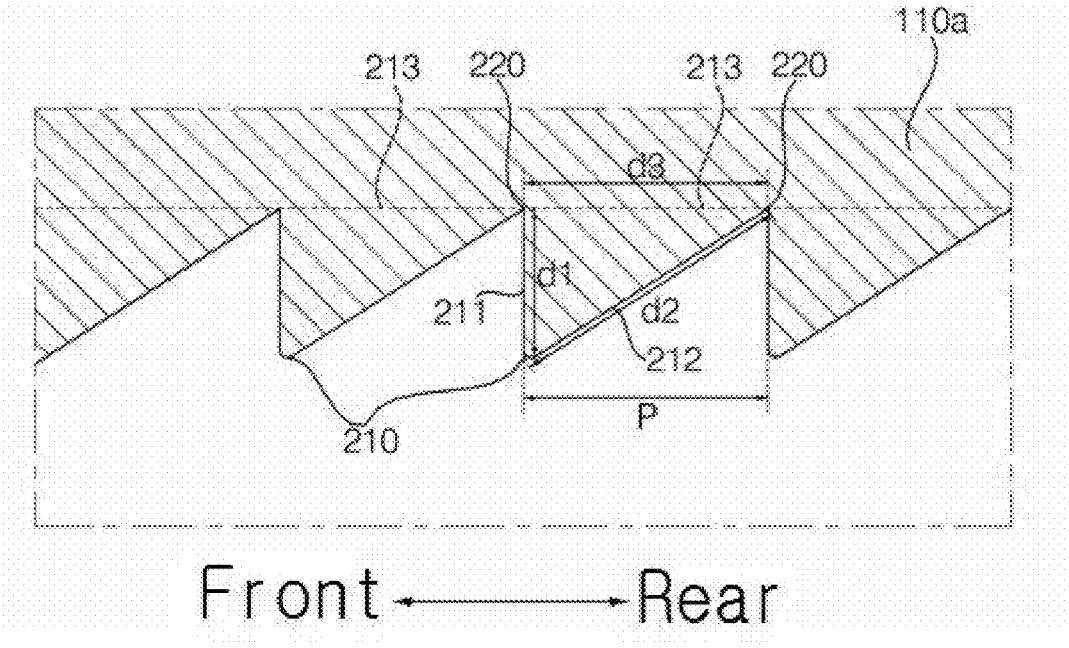
FIG. 9C is a sectional view taken along line I-I of FIG. 9A.
Figure 10:
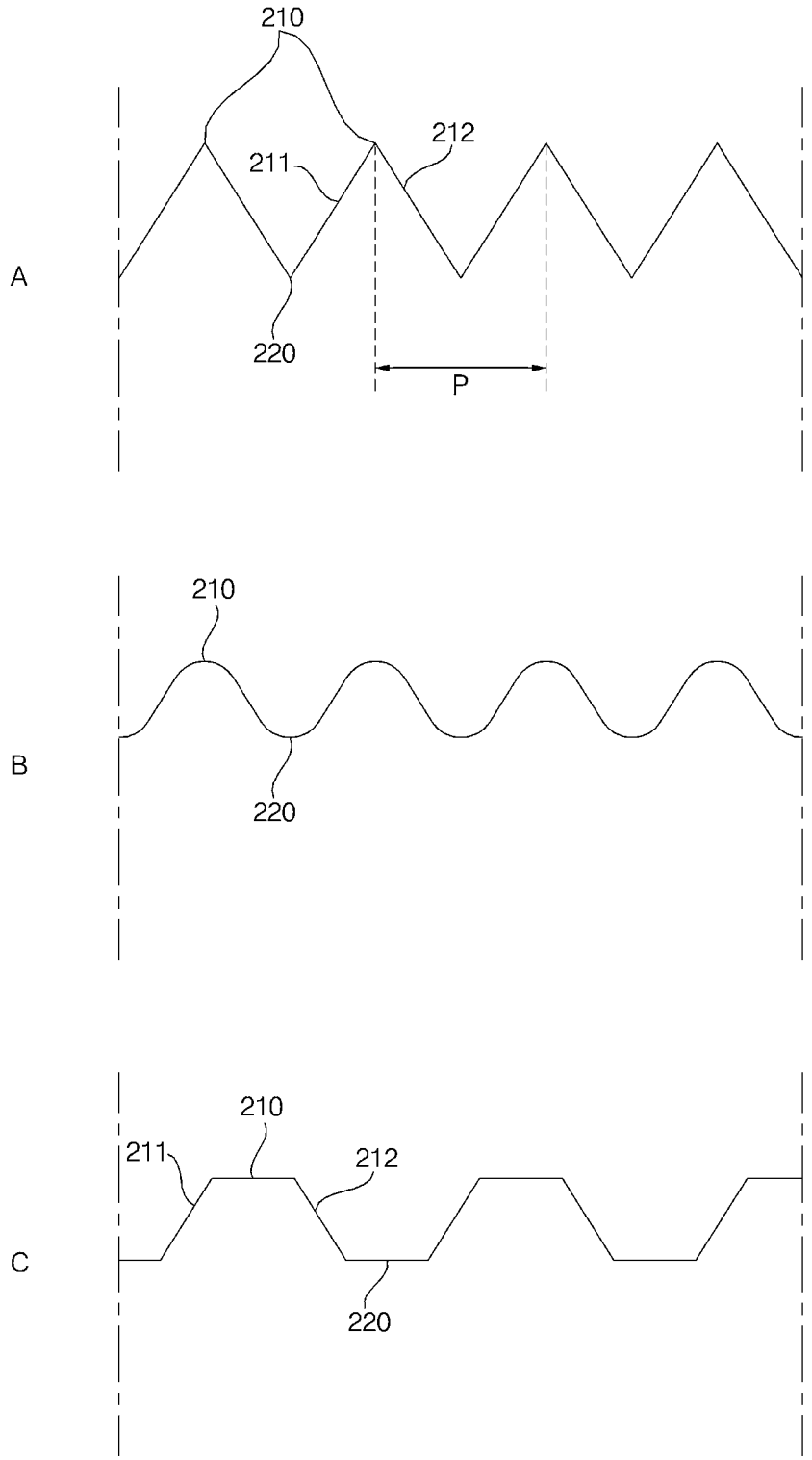
FIGS. 10A-10C are sectional views showing guide channels according to various embodiments of the present invention.

FIG. 3 is a perspective view showing a vegetable container according to an embodiment of the present invention, FIG. 4 is a perspective view showing a state in which the vegetable container according to the embodiment of the present invention is open, FIG. 5 is a perspective view showing a case according to an embodiment of the present invention, FIG. 6 is a perspective view showing a state in which a reinforcing member is coupled to the case according to the embodiment of the present invention, FIG. 7 is a side sectional view of the case according to the embodiment of the present invention, FIG. 8 is a front view of the case according to the embodiment of the present invention, FIG. 9A is a partial plan view showing the top surface and the lateral surfaces of the case according to the embodiment of the present invention, FIG. 9B is a partial plan view of the top surface of the case according to the embodiment of the present invention when viewed from the interior of the case, FIG. 9C is a sectional view taken along line I-I of FIG. 9A, and FIGS. 10A-10C are sectional views showing guide channels according to various embodiments of the present invention.

Referring to FIGS. 3 to 7, the vegetable container 100 includes a case 110, a drawer 120, a discharge port 180, a negative pressure part 190, and an opening and closing valve 170.

In addition, the vegetable container 100 may further include guide channels 200*a* to 200*d*.

The case 110 defines the external appearance of the vegetable container 100. The case 110 is mounted in the storage compartments F and R of the main body 2 of the refrigerator. In addition, the case 110 is configured to have a double structure including an inner case and an outer case. The outer case may be fixed in the storage compartments F and R and the inner case may be mounted in the outer case such that the inner case can be withdrawn from the outer case.

The case 110 has an opening 113 formed at the front thereof. In the case 110 is defined having a receiving space A to store objects.

For example, the case 110 may be formed in the shape of a rectangular parallelepiped having the receiving space A defined therein. More specifically, only the front (opening 113) of the case 110, through which the drawer 120 is inserted or withdrawn, may be opened and the other five faces of the case 110 may be closed. That is, in FIG. 5, the opening 113 is formed at the front of the case 110 and a rear surface 110*d* is disposed at the rear of the case 110. A top surface 110*a* and a bottom surface 110*c* may be disposed at the top and bottom of the case 110 and lateral surfaces 110*b* may be disposed at opposite sides of the case 110. The top surface 110*a* and the bottom surface 110*c* of the case 110 may have larger area than the lateral surfaces 110*b* of the case 110.

The negative pressure part 190 to generate negative pressure (over-vacuum) in the case 110 may be mounted at one side of the case 110. For example, the negative pressure part 190 may be constituted by a pump (vacuum Pump).

In addition, although not shown, the negative pressure part 190 may be connected to the case 110 via a connection pipe. When the drawer 120 is inserted into the case 110, the negative pressure part 190 may discharge air from the case 110 to decompress the case 110.

At the edge of the opening 113, there may be further formed a flange 119 extending outside the receiving space A. That is, the flange 119 may be formed at the front of the case 110 such that the flange 119 extends outward.

The flange 119 may be disposed perpendicularly to the lateral surfaces 110*b* and the top and bottom surfaces 110*a* and 110*c* of the case 110. The flange 119 being disposed perpendicularly to the lateral surfaces 110*b* and the top and bottom surfaces 110*a* and 110*c* of the case 110 may mean that the flange 119 extends in the vertical direction and in the horizontal direction of the case 110. In addition, the term "perpendicularly" does not mean "completely perpendicularly" in mathematical terms but means "perpendicularly while having an error" in engineering terms.

The flange 119 may be disposed perpendicularly from the top surface 110*a* and the bottom surface 110*b* of the case 110 to prevent the edge of the opening 113 from drooping due to negative pressure generated in the case 110. Specifically, the flange 119 may be formed in the vertical direction of the case 110 to function as a bending stress support to resist bending stress generated at the edge of the opening 113.

In addition, the flange 119 provides a region contacting the drawer 120 when the drawer 120 hermetically seals the case 110. Particularly, in a case in which the interior of the case 110 is maintained almost in a vacuum state, it is necessary for the interior of the case 110 to be completely isolated from the outside. Since the flange 119 provides a space in which the drawer 120 contacts, the flange 119 improves hermetical sealing performance of the vegetable container 100. In addition, in a case in which a hermetical sealing member 140 is used at a contact area between the drawer 120 and the case 110, the flange 119 may provide a space in which the hermetical sealing member 140 contacts.

At least one surface of the edge of the opening 113 may be configured to have an arch structure in which the middle portion of the surface of the edge of the opening 113 protrudes outward from the receiving space A.

For example, as shown in FIG. 5, the edge of the opening 113 has a rectangular shape including the top surface 110*a*, the bottom surface 110*c*, and the lateral surfaces 110*b* of the case 110. The top surface 110*a* and the bottom surface 110*c* of the case 110 are generally longer than the lateral surfaces 110*b* of the case 110. As a result, the top surface 110*a* and the bottom surface 110*c* of the case 110 may be greatly deformed due to bending stress generated by the difference in pressure between the inside and the outside of the case 110. In a case in which one surface (for example, the front end of the top surface 110*a* of the case 110) of the edge of the opening 113 has an arch structure in which the middle portion of the surface of the edge of the opening 113 protrudes outward from the receiving space A, it is possible to effectively resist bending stress applied in the internal direction of the case 110. That is, in a case in which the edge of the opening 113 is designed to have an arch structure, it is possible to prevent the circumference of the opening 113 of the case 110 from being bent inside the case 110.

The case 110 may further include a reinforcing rib 111 to increase strength of the case 110.

The reinforcing rib 111 is a member formed in the direction in which the case 110 is deformed. The reinforcing rib 111 may be integrally formed with the case 110 by injection molding.

For example, the reinforcing rib 111 may be formed at the outer surface of the case 110 to secure the receiving space A in the case 110. In addition, a plurality of reinforcing ribs 111 may be formed in a first direction and a plurality of reinforcing ribs 111 may be further formed in a direction intersecting the first direction.

In the inner surface of the case 110, there may be formed rails 117 to guide the drawer 120 such that the drawer 120 can be inserted into and withdrawn from the case 110 in a drawer fashion. For example, the rails 117 may be formed at the inner lateral surfaces of the case 1110 such that the rails 117 extend from the front to the rear.

The drawer 120 hermetically seals the interior of the case 110. The drawer 120 defines the external appearance of the vegetable container 100 together with the case 110.

For example, the drawer 120 may include a receiving part 123 defining a receiving space to receive objects to be stored and a front part 121 disposed at the front of the receiving part 123.

The receiving part 123 is inserted into and withdrawn from the case 110 in a drawer fashion. For example, guides 129 corresponding to the rails 117 of the case 110 are formed at the outer surface of the receiving part 123 such that the receiving part 123 can move forward from the case 110 and backward into the case 110 along the rails 117.

For example, the receiving part 123 may have a hexahedral shape opened at the top and the front thereof.

The front part 121 may be disposed at the front of the receiving part 123. The front part 121 may be formed to have a larger size than the receiving part 123. Consequently, the edge of the front part 121 contacts the edge of the opening 113 to hermetically seal the case 110.

The front part 121 may be formed approximately in the shape of a rectangle (rectangular parallelepiped). More specifically, the front part 121 may have a size and a shape corresponding to the size and the shape of the flange 119 of the opening 113. That is, the front part 121 may be formed so as to contact the flange 110 of the case 110. In addition, the front part 121 may be provided with a grip 125 for withdrawal or insertion.

The grip 125 may be provided at the upper region of the front part 121.

For example, the grip 125 may be depressed toward the rear such that a grip space is formed from the surface of the front part 121.

In a case in which the interior of the case 110 is hermetically sealed by the drawer 120, the difference in pressure between the inside and the outside of the case 110 is generated. That is, when the interior of the case 110 is hermetically sealed by the drawer 120, the interior of the case 110 is decompressed by the negative pressure part 190 with the result that the pressure inside the case 110 becomes lower than the pressure outside the case 110.

The hermetical sealing member 140 may be provided at a contact region between the front part 121 of the drawer 120 and the edge of the opening 113 to isolate the inside of the case 110 from the outside of the case 110.

For example, the hermetical sealing member 140 may be made of a rubber material.

The hermetical sealing member 140 may be formed along the edge (or the flange 119) of the opening 113 in a closed loop shape.

Between the case 110 and the drawer 120, there may be provided a hermetical sealing retention device 160 to retain an isolated state of the inside of the case 110 from the outside of the case 110.

For example, the hermetical sealing retention device 160 may include a catching part coupled to one selected from between the drawer 120 and the case 110 and a fastening part coupled to the other selected from between the drawer 120 and the case 110 such that the fastening part can be fastened to the catching part. However, the present invention is not limited thereto. The hermetical sealing retention device 160 may have various structures.

Referring to FIGS. 5, 7, and 8, the discharge port 180 is formed at the bottom surface 110*c* of the case 110 such that water formed in the case 110 is collected at the discharge port 180. Specifically, the discharge port 180 is formed through the bottom surface 110*c* of the case 110 such that water formed in the case 110 is discharged out of the case 110 through the discharge port 180.

The discharge port 180 is positioned lower than the bottom surface 110*c* of the case 110 such that water formed in the case 110 can be collected at the discharge port 180 due to gravity. The water in the case 110 may be dew formed as the result of saturation of moisture in the case 110 when the temperature in the case 110 is lowered to a dew point or less.

More specifically, the bottom surface 110*c* of the case 110 may be inclined downward toward the discharge port 180 such that water flowing due to gravity can be effectively guided to the discharge port 180.

A various number of discharge ports 180 may be provided. In a case in which one discharge port 180 is provided, the discharge port 180 may be disposed approximately at the middle portion of the bottom surface 110*c* of the case 110 for advantageous water collection.

In the discharge port 180, there may be provided an opening and closing valve 170 to open and close the discharge port 180 so as to control discharge of water collected at the discharge port 180. The opening and closing valve 170 will hereinafter be described in detail.

Referring to FIGS. 5 to 10C, the guide channels 200*a* to 200*d* are formed at the inner surface of the case 110 to guide water formed in the case 110 to the discharge port 180. In addition, the guide channels 200*a* to 200*d* serve to hide dew formed in the case 110 such that the dew cannot be observed by the naked eye.

The guide channels 200*a* to 200*d* may be formed at at least a portion of the inner surface of the case 110. Of course, the guide channels 200*a* to 200*d* may be formed at the entire inner surface of the case 110.

The guide channels 200*a* to 200*d* may have various shapes.

Referring to FIGS. 9A-9C, the guide channels 200*a* to 200*d* may be formed at the inner surface of the case 110 such that the guide channels 200*a* to 200*d* depress and protrude to guide water toward the discharge port 180.

For example, the guide channels 200*a* to 200*d* may include at least two mountain parts 210 protruding toward the inside of the case 110 and at least one valley part 220 disposed between the respective mountain parts 210, the valley part 220 being depressed toward the outside of the case 110.

The mountain parts 210 extend in the left and right direction of the case 110. A plurality of mountain parts 210 are repeatedly arranged from the front to the rear of the case 110.

The mountain parts 210 are parts extending in one direction in a state in which the mountain parts 210 protrude more than the valley part 220 such that water formed in the case 110 can flow to the valley part 220. The valley part 220 is formed between the respective mountain parts 210 such that the valley part 220 is lower than the mountain parts 210 to provide a water guide channel.

In particular, referring to FIGS. 10A-10C, each of the mountain parts 210 may have any one selected from among a triangular shape, a quadrangular shape, and a semicircular shape as a sectional shape. In a case in which the sectional shape of each of the mountain parts 210 is the triangular shape or the semicircular shape, dew formed on the inner surface of the case 110 easily flows to the valley part 220 such that the dew cannot be observed by the naked eye.

More specifically, each of the mountain parts 210 may be defined by two inclined sides 211 and 212. That is, each of the mountain parts 210 may have a triangular or quadrangular section having two inclined sides 211 and 212.

The mountain parts 210 and the valley parts 220 are alternately arranged from the front to the rear of the case 110. When the temperature in the case 110 is lowered to a dew point or less, moisture in the case 110 may be saturated to form dew. The dew flows from the mountain parts 210 to the valley parts 220 and is stored in the valley parts 220. In particular, the dew does not stay on the protruding mountain parts 210 but moves to the depressed valley parts 220 due to cohesive force of water and adhesive force between the water and the inner surface of the case 110.

In addition, when the dew is stored in the valley parts 220 in a state in which the mountain parts 210 and the valley parts 220 are alternately arranged from the front to the rear of the case 110, a user located in front of the case 110 cannot easily see the dew stored in the valley parts 220. That is, the dew is not visible. This is because the mountain parts 210 extending from the left side to the right side of the case 110 may obstruct the user's field of vision.

Specifically, referring to FIG. 9C, each of the mountain parts 210 may have an approximately right-angled triangular shape as a sectional shape (taken along a line directed from the front to the rear of the case 110).

More specifically, each of the mountain parts 210 may be defined by a first inclined side 211 and a second inclined side 212 extending from opposite ends of a base 213 to form an apex.

The base 213 is an arbitrary line interconnecting adjacent valley parts 220.

A length ratio (d3:d1:d2) of the base 213, the first inclined side 211, and the second inclined side 212 may be 1.4 to 1.6:1.9 to 2.1:2.36 to 2.64. When a Pythagoras theorem is applied, therefore, each of the mountain parts 210 may have an approximately right-angled triangular shape in which an inner angle defined between the base 213 and the first inclined side 211 is approximately 90 degrees as a sectional shape.

The mountain parts 210 and the valley parts 220 are symmetrical with respect to the second inclined side 212.

In a case in which the mountain parts 210 and the valley parts 220 are formed in a quadrangular shape, dew formed on the inner surface of the case 110 cannot easily move to the valley parts 220. Consequently, the dew may stay on the mountain parts 210 with the result that the user may observe the dew.

In a case in which the mountain parts 210 and the valley parts 220 are formed in a triangular shape, dew formed on the inner surface of the case 110 can easily move to the valley parts 220. In particular, the dew formed on the inner surface of the case 110 has a large contact area between the inner surface of the case 110 between the first inclined side 211 and the second inclined side 212. Such a large contact area improves adhesive force with the dew. As a result, the dew can easily move to the valley part 220.

Particularly, in a case in which the mountain parts 210 and the valley parts 220 are formed in a right-angled triangular shape, dew formed on the inner surface of the case 110 can more easily move to the valley parts 220. Specifically, in a case in which an interior angle (an angle between the first inclined side 211 and the second inclined side 212) of each of the valley parts 220 is increased, the dew formed at the apexes of mountain parts 210 cannot easily move to the valley parts 220. On the other hand, in a case in which the interior angle (the angle between the first inclined side 211 and the second inclined side 212) of each of the valley parts 220 is excessively decreased, the height of each of the mountain parts 210 is excessively increased with the result that the strength of the case 110 is lowered and the thickness of the case 110 is increased.

In a case in which the mountain parts 210 and the valley parts 220 are formed in a right-angled triangular shape, it is desirable to configure the mountain parts 210 and the valley parts 220 such that the interior angle (the angle between the first inclined side 211 and the second inclined side 212) of each of the valley parts 220 is decreased while the height of each of the mountain parts 210 is not excessively increased to improve adhesive force between water and the valley parts 220.

The first inclined side 211 of each of the mountain parts 210 may be located more at the front of the case 110 than the second inclined side 212 of each of the mountain parts 210.

The apex of each of the mountain parts 210 formed by the first inclined side 211 and the second inclined side 212 may be rounded to prevent dew formed at the apex of each of the mountain parts 210 from dropping into the case 110 due to gravity and to guide the dew formed at the apex of each of the mountain parts 210 to the valley parts 220.

A pitch P between the respective mountain parts 210 may be 1.5 mm to 2.5 mm. In a case in which the pitch P between the respective mountain parts 210 is greater than 2.5 mm, dew formed on the inner surface of the case 110 cannot easily move to the valley parts 220. On the other hand, in a case in which the pitch P between the respective mountain parts 210 is less than 1.5 mm, each of the valley parts 220 cannot provide a sufficient space to collect dew with the result that the dew may be observed by the naked eye.

In addition, each of the mountain parts 210 may have a height of 1.5 mm to 2.5 mm. In a case in which the height of each of the mountain parts 210 is too large, the strength of the case 110 is lowered. On the other hand, in a case in which the height of each of the mountain parts 210 is too small, each of the valley parts 220 cannot provide a sufficient space to collect dew.

Referring to FIG. 9B, the embodiment of the present invention may further include auxiliary channels 225 intersecting the guide channels 200, the auxiliary channels 225 being depressed in the inner surface of the case 110.

Dew formed in the case 110 moves along the valley parts 220 in the left and right direction of the case 110. Movement of the dew to the front and the rear of the case 110 is restricted by the mountain parts 210. In a case in which the amount of dew formed in the case 110 is excessive, the dew may not spread out along the valley parts 220 but may drop into the case 110.

The auxiliary channels 225 intersect the mountain parts 210 and the valley parts 220 to guide water to adjacent other valley parts 220 in a case in which the amount of dew formed in the case 110 is excessive.

Specifically, the auxiliary channels 225 extend from the front to the rear of the case 110 such that the auxiliary channels 225 communicate with the plural valley parts 220.

Hereinafter, the guide channels 200*a* to 200*d* formed at the respective surfaces of the case 110 will be described in detail.

Referring to FIGS. 5 and 7 to 10C, the guide channels 200*a* to 200*d* may include top surface guide channels 200*a*, lateral surface guide channels 200*b*, rear surface guide channels 200*d*, and bottom surface guide channels 200*c*.

The top surface guide channels 200*a* are formed at the inner side of the top surface 110*a* of the case 110. The mountain parts 210 and the valley parts 220 of the top surface guide channels 200*a* may extend toward the lateral surfaces 110*b* of the case 110. In addition, the mountain parts 210 and the valley parts 220 of the top surface guide channels 200*a* may extend from the front to the rear surface 110*d* of the case 110.

The top surface 110*a* of the case 110 may be inclined downward from the middle of the case to the lateral surfaces 110*b* of the case 110 such that water formed on the inner surface of the case 110 is guided to the lateral surfaces 110*b* of the case 110 along the top surface guide channels 200*a* due to gravity. That is, as shown in FIG. 8, the top surface 110*a* of the case 110 may be configured to have an arch structure in which the middle portion of top surface 110*a* of the case 110 protrudes upward from the case 110. In a case in which the top surface 110*a* of the case 110 is formed as described above, the strength of the top surface 110*a* of the case 110 is increased and water formed on the top surface 110*a* of the case 110 can be guided to the lateral surfaces 110*b* of the case 110 due to gravity.

The lateral surface guide channels 200*b* are formed at the inner sides of the lateral surfaces 110*b* of the case 110. The mountain parts 210 and the valley parts 220 of the lateral surface guide channels 200*b* may extend from the top surface 110*a* of the case 110 to the bottom surface 110*c* of the case 110 such that water formed on the lateral surfaces 110*b* of the case 110 can flow toward the bottom surface 110*c* of the case 110 due to gravity.

In addition, the valley parts 220 of the top surface guide channels 200*a* may be connected to (communicate with) the valley parts 220 of lateral surface guide channels 200*b* such that water formed on the top surface 110*a* of the case 110 can be effectively guided to the lateral surfaces 110*b* of the case 110.

The rear surface guide channels 200*d* are formed at the inner side of the rear surface 110*d* of the case 110. The mountain parts 210 and the valley parts 220 of the rear surface guide channels 200*d* may extend from the top surface 110*a* of the case 110 to the bottom surface 110*c* of the case 110 such that water formed on the rear surface 110*d* of the case 110 can flow toward the bottom surface 110*c* of the case 110 due to gravity.

The bottom surface guide channels 200*c* are formed at the inner side of the bottom surface 110*c* of the case 110.

The mountain parts 210 and the valley parts 220 of the bottom surface guide channels 200*c* may extend toward the discharge port 180 such that water formed in the case 110 can flow toward the discharge port 180 due to gravity. In addition, the bottom surface guide channels 200*c* may be inclined downward to the discharge port 180 to more effectively collect water.

For example, the bottom surface guide channels 200*c* may extend from the discharge port 180 in a radial manner. Of course, the valley parts 220 of the top surface guide channels 200*a*, the valley parts 220 of the lateral surface guide channels 200*b*, and the valley parts 220 of the bottom surface guide channels 200*c* may be connected to (communicate with) each other to effectively collect water.

As shown in FIG. 8, therefore, water (dew) formed in the case 110 may flow along a water movement channel f and then be collected at the discharge port 180.

A reinforcing part functions to increase the strength of the case 110.

For example, referring to FIGS. 3 and 5, the reinforcing part may be embodied as a reinforcing member 130 coupled to one surface of the case 110. In a case in which the opening 113 is formed at the front of the case 110, when the pressure inside the case 110 is lower than the pressure outside the case 110, the result is that the edge of the opening 113 droops toward the interior of the case 110. The reinforcing member 130 may prevent the edge of the opening 113 from drooping. The edge of the opening 113 includes front tips of the top surface 110*a* of the case 110, the bottom surface 110*c* of the case 110, and the lateral surfaces 110*b* of the case 110.

More specifically, the reinforcing member 130 may be disposed at the largest one of the surfaces of the case 110. That is, in a case in which the case 110 is formed in the shape of a rectangular parallelepiped having the opening 113 formed at the front thereof as shown in FIG. 5, the tips of the largest one (the top surface 110*a* or the bottom surface 110*c* of the case 110) of the surfaces of the case 110 are the most greatly deformed when the difference in pressure between the inside and the outside of the case 110 is formed. In a case in which the reinforcing member 130 is disposed at the largest one of the surfaces of the case 110 while being adjacent to the edge of the opening 113, it is possible to effectively prevent deformation of the opening 113.

The reinforcing member 130 may be disposed at the top surface 110*a* of the case 110. In addition, the reinforcing member 130 may be disposed at the outside of the top surface 110*a* of the case 110 since the receiving space A is reduced in a case in which the reinforcing member 130 is disposed inside the case 110.

The reinforcing member 130 may be disposed adjacent to the opening 113 since the edge of the opening is the most greatly deformed.

The reinforcing member 130 may be disposed in parallel to the edge of the opening 113. The term "parallel" does not mean "parallel" in mathematical terms but means "parallel while having an error" in engineering terms. In addition, the term "parallel" may mean "parallel" between curved lines disposed to correspond to each other while being spaced apart from each other by a fixed distance as well as "parallel" between straight lines. In a case in which the reinforcing member 130 is disposed in parallel to the edge of the opening 113, it is possible to more effectively prevent deformation of the edge of the opening 113.

In addition, the reinforcing member 130 may be disposed at the top surface 110*a* and/or the bottom surface 110*c* of the case 110 in a state in which one side of the reinforcing member 130 is coupled to the flange 119. In a case in which the reinforcing member 130 is coupled to the flange 119, it is possible to more effectively prevent deformation of the edge of the opening 113.

The reinforcing member 130 may have various shapes of high resistance to bending stress. For example, the reinforcing member 130 may include a first member 131, a second member 133 spaced apart from the first member 131, and a connection member 135 connected between the first member 131 and the second member 133, the connection member 135 having a through hole 136, through which a bolt fastened to the case 119 is inserted. That is, the reinforcing member 130 may have a bracket shape of high resistance to bending stress. The case 110 is provided at a portion thereof corresponding to the through hole 136 with a boss 114, to which the bolt is fastened.

The first member 131 and the second member 133 may be disposed perpendicularly to the top surface of the case 110 to improve resistance to bending stress. That is, the first member 131 and the second member 133 may be disposed in the upward and downward direction of the case 110.

In addition, one end of the first member 131 and one end of the second member 133 may contact one surface of the case 110 while having the same height as the reinforcing rib 111 to reduce a space occupied by the reinforcing member 130. In this case, the connection member 135 may have the same height as the upper end of the reinforcing member 130.

The reinforcing member 130 may be made of a material having higher strength than the case 110. For example, the reinforcing member 130 may be made of a metal material or an alloy material. Specifically, the reinforcing member 130 may be made of at least one selected among steel, a steel alloy, an aluminum alloy, a titanium alloy, stainless steel, and a stainless steel alloy. However, the present invention is not limited thereto.

Figure 11:
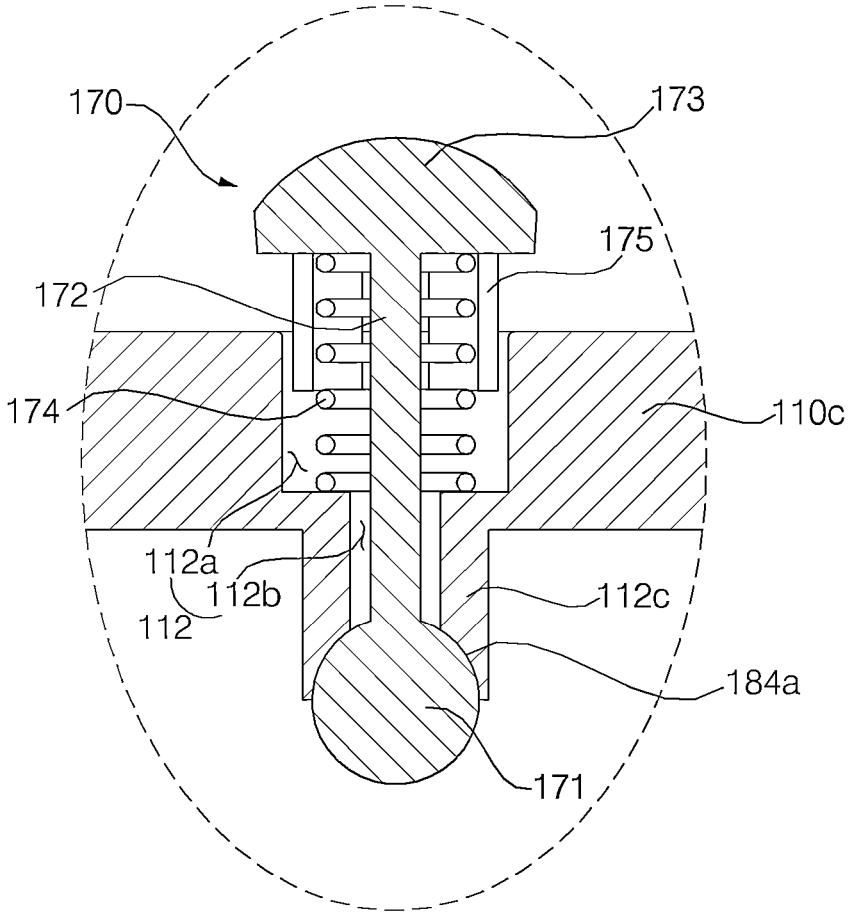
FIG. 11 is an enlarged sectional view showing part B of FIG. 7.
Figure 12:
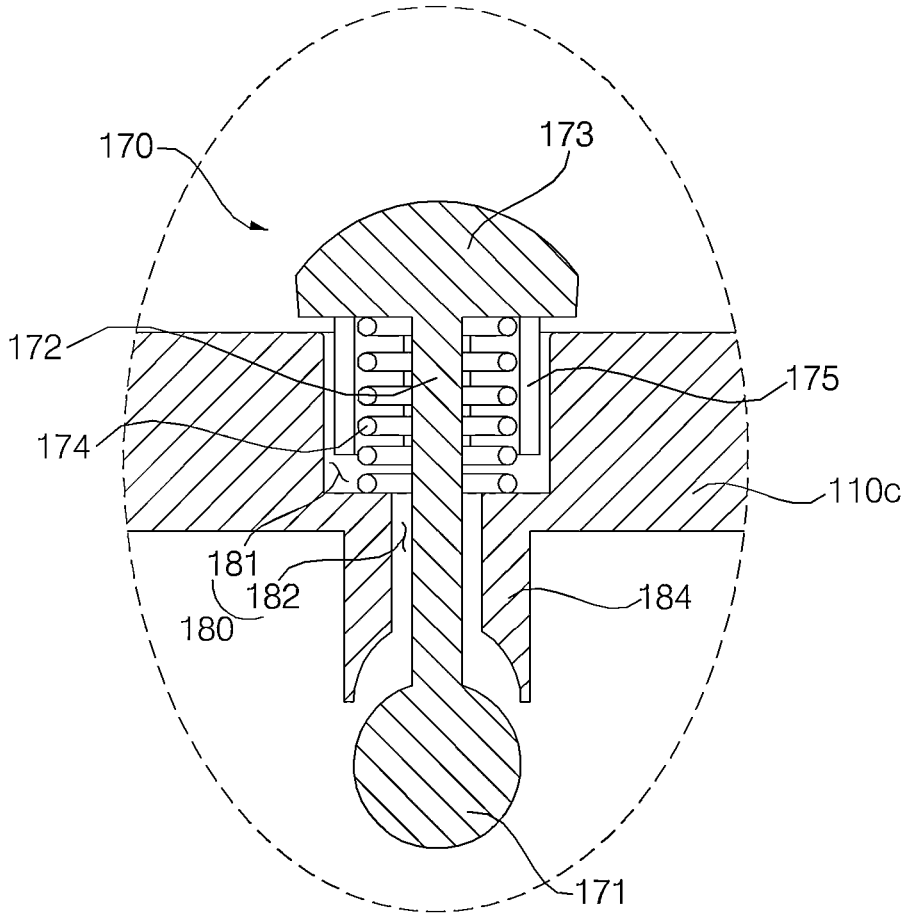
FIG. 12 is a sectional view showing a state in which an opening and closing valve of FIG. 11 is open.
Figure 13:
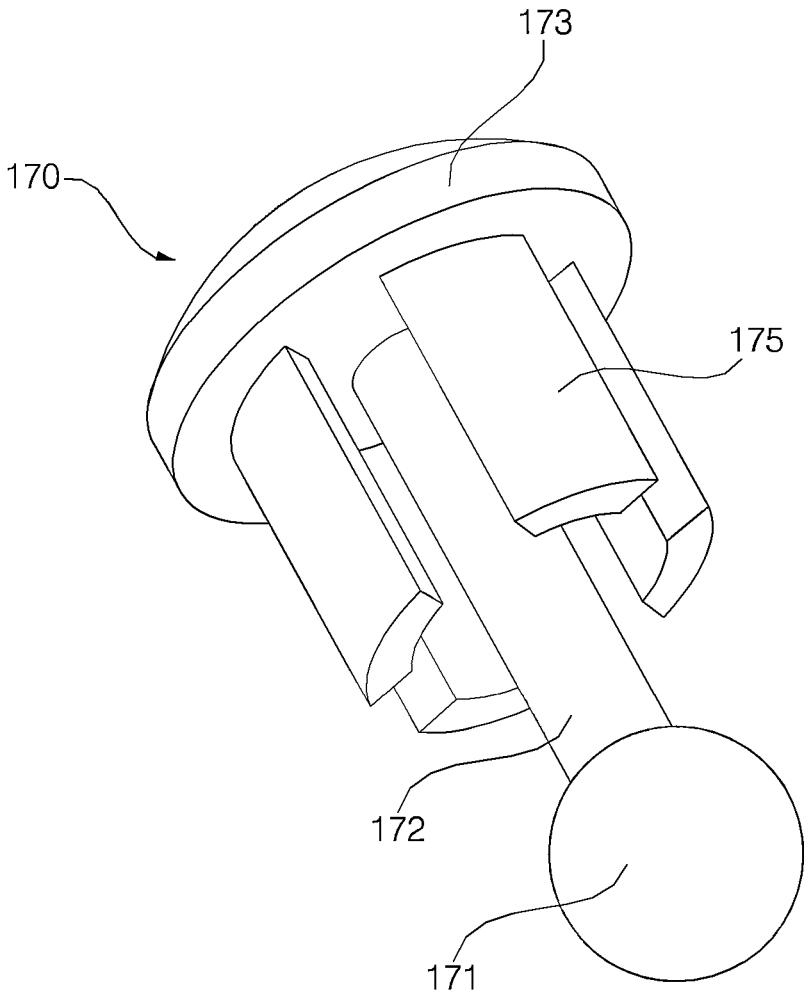
FIG. 13 is a perspective view showing an opening and closing valve according to an embodiment of the present invention.

FIG. 11 is an enlarged sectional view showing part B of FIG. 7, FIG. 12 is a sectional view showing a state in which an opening and closing valve of FIG. 11 is open, and FIG. 13 is a perspective view showing an opening and closing valve according to an embodiment of the present invention.

Referring to FIGS. 11 to 13, the discharge port 180 may include a water collection part 181 and a discharge part 182. Directions hereinafter mentioned are based on FIGS. 11 and 12.

As shown in FIG. 11, the discharge port 180 is a hole formed through the bottom surface 110*c* of the case 110. The shape of the discharge port 180 is not particularly restricted. The discharge port 180 may have various shapes so long as the discharge port 180 provides a water discharge channel. However, the discharge port 180 may have a shape corresponding to a valve shaft 172 of the opening and closing valve 170 such that the valve shaft 172 of the opening and closing valve 170 can reciprocate in the discharge port 180.

The water collection part 181 may be depressed in a portion of the bottom surface 110*c* of the case 110 to collect water in the case 110. The water collection part 181 is a part to which water formed in the case 110 flows along the inner surface of the case 110 such that the water is collected at the water collection part 181. In addition, an elastic spring 174, which will hereinafter be described, is located in the water collection part 181 such that elastic force of the elastic spring 174 is supported by the water collection part 181.

The discharge part 182 allows the water collection part 181 to communicate with the outside of the case 110 such that the water collected at the water collection part 181 can be discharged out of the case 110. The discharge part 182 may have a smaller width than the water collection part 181. The width means a length in the left and right direction in FIG. 11. In addition, the discharge part 182 may have a smaller size or inner diameter than the water collection part 181.

One end of the elastic spring 174 is located at a step (or the bottom of the water collection part 181) formed by the difference in width between the water collection part 181 and the discharge part 182.

More specifically, the water collection part 181 and the discharge part 182 may each be formed in the shape of a hole. The water collection part 181 and the discharge part 182 may have the same central axis. The outer diameter of the water collection part 181 may be greater than the outer diameter of the discharge part 182. That is, the water collection part 181 may be depressed in a portion of the bottom surface 110*c* of the case 110 and the discharge part 182 may be formed through the bottom surface of the water collection part 181 such that the discharge part 182 communicates with the outside of the case 110.

For example, the discharge part 182 may be a through hole formed through the bottom of the water collection part 181. In another example, the discharge part 182 may be a hole formed by a boss 184 protruding downward from the bottom surface 110*c* of the case 110.

The boss 184 may be integrally formed with the case 110. Alternatively, the boss 184 may be separately manufactured and then coupled to the case 110. The boss 184 protrudes downward from the bottom surface 110*c* of the case 110 to provide a space into which a plug 171 of the opening and closing valve 170 is inserted such that the plug 171 of the opening and closing valve 170 can hermetically seal the boss 184.

For example, an empty space, in which the discharge port 182 is defined, is provided in the boss 184. The opening and closing valve 170 reciprocates in the empty space. Water is discharged from the case 110 through the empty space. In addition, a hermetical sealing surface 184*a* corresponding to the plug 171 may be formed at the surface of the boss 184 contacting the plug 171.

More specifically, in a case in which the plug 171 is formed in a globular shape, the hermetical sealing surface 184*a* may be depressed in one end of the boss 184.

In addition, the boss 184 may be made of any one selected from among rubber, synthetic resin, and silicone to increase hermetical sealing force. Of course, the boss 184 may be made of the same material as the case 110.

In this embodiment, the opening and closing valve 170 may reciprocate in the discharge port 180 to open and close the discharge port 180. In addition, the opening and closing valve 170 may be moved to one side by external force such that the opening and closing valve 170 is opened and the opening and closing valve 170 may be moved to the other side by elastic force such that the opening and closing valve 170 is closed. For example, the opening and closing valve 170 may be moved to one side by contact with the drawer 120 such that the opening and closing valve 170 is opened and the opening and closing valve 170 may be moved to the other side by elastic force such that the opening and closing valve 170 is closed.

The position of the opening and closing valve 170 is not particularly restricted. The opening and closing valve 170 may be disposed adjacent to the opening 113 of the case 110. In a case in which the opening and closing valve 170 is disposed adjacent to the opening 113 of the case 110, the opening and closing valve 170 cannot be observed by the naked eye unless the drawer is completely separated from the case 110.

For example, the opening and closing valve 170 may include a plug 171, a head 173, a valve shaft 172, and an elastic spring 174.

The plug 171 reciprocates upward and downward to open and close the discharge part 182.

The plug 171 may have various shapes to open and close the discharge part 182 and to hermetically seal the discharge part 182. For example, the plug 171 may have a larger width (or outer diameter) than the discharge part 182. The plug 171 may be formed in a globular shape. Of course, the hermetical sealing surface 184*a* may be formed at one side of the boss 184 in which the plug 171 contacts. In addition, the plug 171 may be located outside the case 110. In another example, the plug 171 may have a larger width (or outer diameter) than the discharge part 182 and a smaller width (or outer diameter) than the boss 184 such that the plug 171 can be inserted into the boss 184 when the discharge part 182 is hermetically sealed by the plug 171.

The plug 171 may be made of rubber or silicone to increase hermetical sealing force with the discharge part 182.

The valve shaft 172 is connected to one end of the plug 171.

One end of the head 173 may be connected to the valve shaft 172. The head 173 may have a larger width than the valve shaft 172. The head 173 may be located in the case 110. Specifically, the head 173 may be located on the water collection part 181 of the discharge port 180. The width of the head 173 may be greater than the width of the valve shaft 172 and the width of the water collection part 181. That is, the width of the head 173 may be greater than the width of the valve shaft 172 to provide a space in which the elastic spring fitted on the valve shaft 172 is supported. In addition, the width of the head 173 may be greater than the width of the water collection part 181 such that the head 173 serves as a stopper caught by the bottom surface 110*c* of the case 110 when the opening and closing valve 170 reciprocates upward and downward. Of course, the head 173 prevents the introduction of foreign matter into the water collection part 181.

The head 173 may further include a plurality of introduction preventing pieces 175 to prevent the introduction of foreign matter having a predetermined size or more. As shown in FIG. 13, the introduction preventing pieces 175 may be disposed around the head 173 such that the introduction preventing pieces 175 are spaced apart from each other. The introduction preventing pieces 175 may extend from the head 173 to the water collection part 181. That is, the introduction preventing pieces 175 may be disposed at the bottom surface of the head 173 in a state in which the introduction preventing pieces 175 are adjacent to the edge thereof such that the introduction preventing pieces 175 are spaced apart from each other. A spacing distance between adjacent ones of the introduction preventing pieces 175 may be adjusted to adjust the size of foreign matter prevented from being introduced into the water collection part 181.

During reciprocation of the opening and closing valve 170, the introduction preventing pieces 175 may reciprocate in the water collection part 181 to also perform a guide function.

The head 173 may contact the bottom surface of the drawer 120 during movement of the drawer 120. Specifically, when the drawer 120 is moved, the bottom surface of the receiving part 123 comes into contact with the head 173 with the result that the head 173 is pushed. When the head 173 is pushed, the opening and closing valve 170 is opened.

The top surface of the head 173 may have a round shape protruding upward to minimize contact with the drawer 120 during movement of the drawer 120.

The valve shaft 172 is connected between the plug 171 and the head 173. The valve shaft 172 extends through the discharge port 180. That is, the valve shaft 172 reciprocates the plug 171 and the head 173 connected to one end and the other end thereof while reciprocating in the discharge port 180. As a result, the reciprocation of the head 173 is transmitted to the plug 171 via the valve shaft 172.

Specifically, the valve shaft 172 may have a smaller width than the head 173 and the plug 171. In addition, the valve shaft 172 may have a smaller width (or outer diameter) than the water collection part 181 and the discharge part 182.

The elastic spring 174 is provided in the discharge port 180 to apply elastic force to reciprocation of the opening and closing valve 170. Specifically, one end of the elastic spring 174 contact the head 173 and the other end of the elastic spring 174 contact the step defined between the water collection part 181 and the discharge part 182. In addition, the elastic spring 174 is located in the water collection part 181. The elastic spring 174 provides restoring force to restore the opening and closing valve 170 to the interior of the case 110.

Hereinafter, operation of the opening and closing valve 170 will be described with reference to FIGS. 11 and 12.

Referring to FIG. 11, in an initial stage, the plug 171 and the discharge part 182 is in a hermetically sealed state by elastic force of the elastic spring 174. As a result, the interior of the case 110 is maintained in a low vacuum state.

Referring to FIG. 12, the head 173 is moved downward as external force is applied to the head 173 (for example, the drawer 120 contacting the head 173). As a result, the head 173 moves the valve shaft 172 and the plug 1171 downward. At this time, the plug 171 becomes spaced apart from the discharge part 182 with the result that water is discharged from the case 110 through the discharge part 182.

Figure 14:
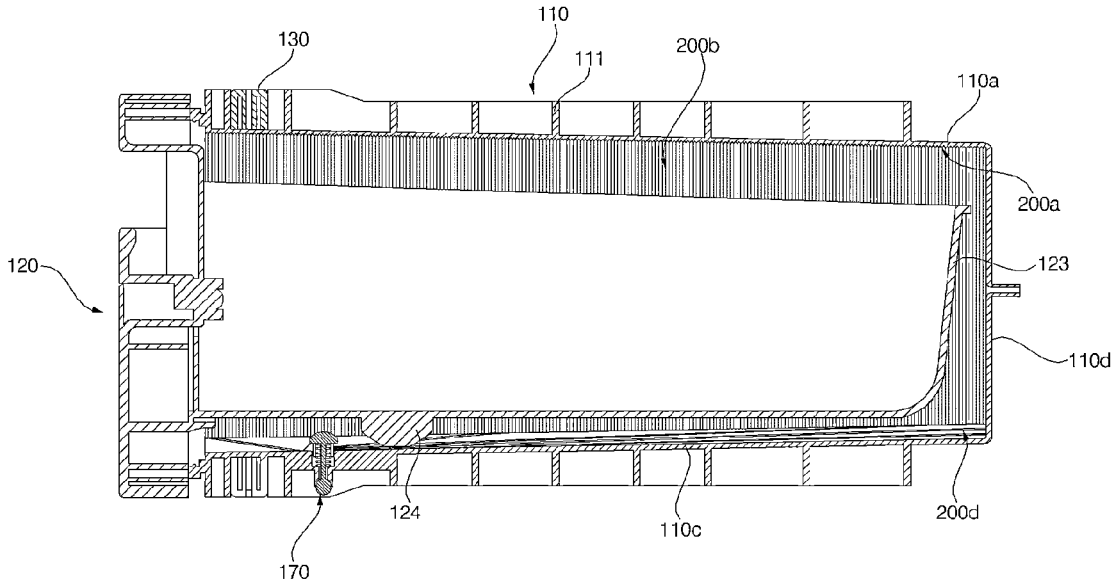
FIGS. 14 and 15 are views illustrating operation of the opening and closing valve according to the embodiment of the present invention.
Figure 15:
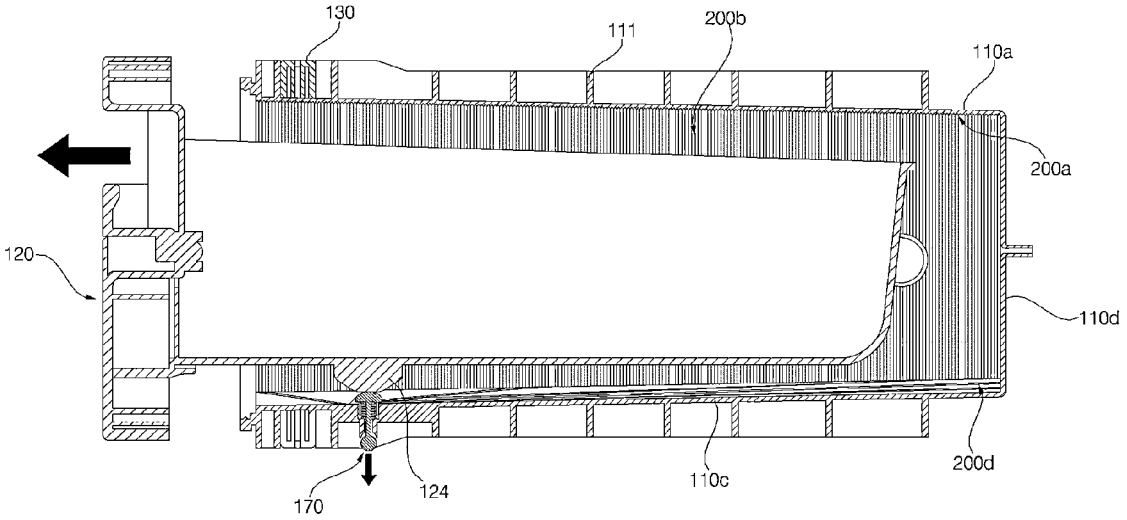

FIGS. 14 and 15 are views illustrating operation of the opening and closing valve according to the embodiment of the present invention.

FIG. 14 is a sectional view showing a state in which the case 110 is hermetically sealed by the drawer 120.

Referring to FIG. 14, the bottom surface of the drawer 120 comes into contact with the head 173 during movement of the drawer 120. Specifically, when the bottom surface of the receiving part 123 of the drawer 120 comes into contact with the head 173 during movement of the bottom surface of the receiving part 123 of the drawer 120, the head 173 is pushed to open the opening and closing valve 170.

The drawer 120 may be further provided at the bottom surface thereof (specifically, the bottom surface of the receiving part 123 thereof) with a push part 124 that can make contact with the head 173. During movement of the drawer 120, the push part 124 comes into contact with the head 173 to push the head 173. The push part 124 may protrude below the receiving part 123.

In an initial stage, the case 110 is hermetically sealed by the drawer 120 and the interior of the case 110 is maintained in a low vacuum state. The opening and closing valve 170 is maintained in a closed state (a state in which the discharge part 182 is hermetically sealed by the plug 171) by elastic force of the elastic spring 174.

FIG. 15 is a sectional view showing a state in which the drawer 120 is opened from the case 110.

The drawer 120 is opened in which the low vacuum state of the interior of the case 110 is released. At this time, the drawer 120 moves to the front of the case 110 and the push part 124 pushes the head 173 of the opening and closing valve 170.

When the head 173 is pushed, the plug becomes spaced apart from the discharge part 182 with the result that water stored at the water collection part 181 is discharged out of the case 110.

In this embodiment, therefore, the discharge port 180 is hermetically sealed by the opening and closing valve 170 due to elastic force of the elastic spring 174 at a normal time with the result that the interior of the case 110 is maintained in a low vacuum state. When the drawer 120 is opened, on the other hand, the opening and closing valve 170 is automatically opened to discharge water formed in the case 110 to the outside.

In addition, in this embodiment, it is possible to discharge water formed in the case 110 to the outside through simple opening and closing of the drawer 120 based on the simple structure without additional control.

Figure 16:
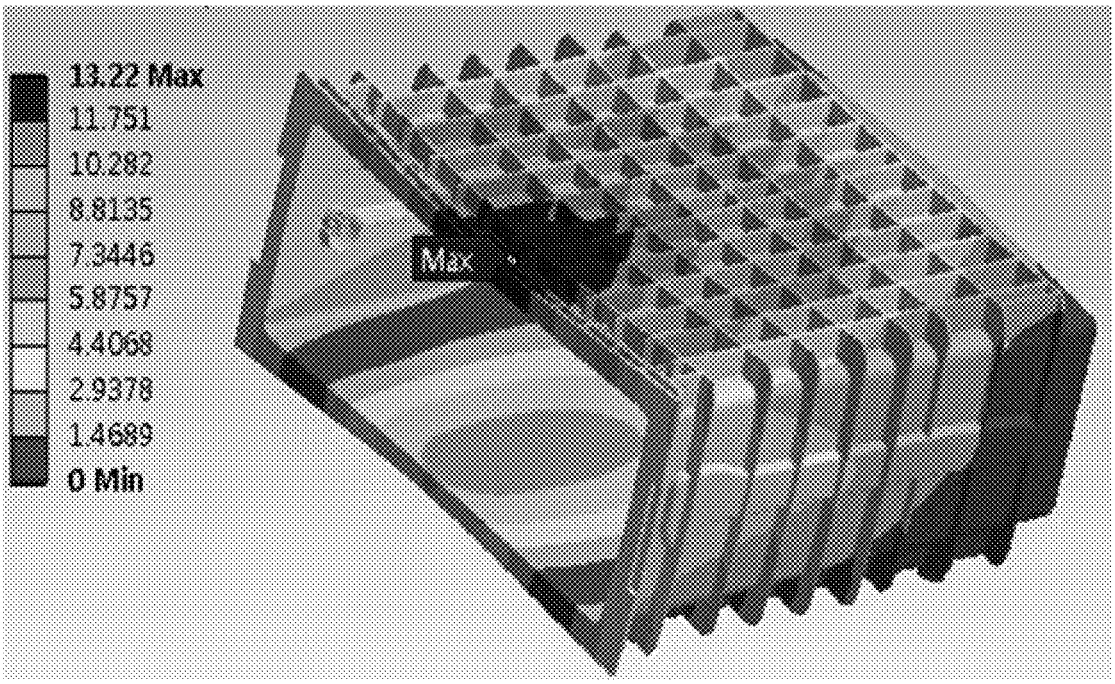
FIG. 16 is a view showing a deformation degree of a case according to a comparative example.
Figure 17:
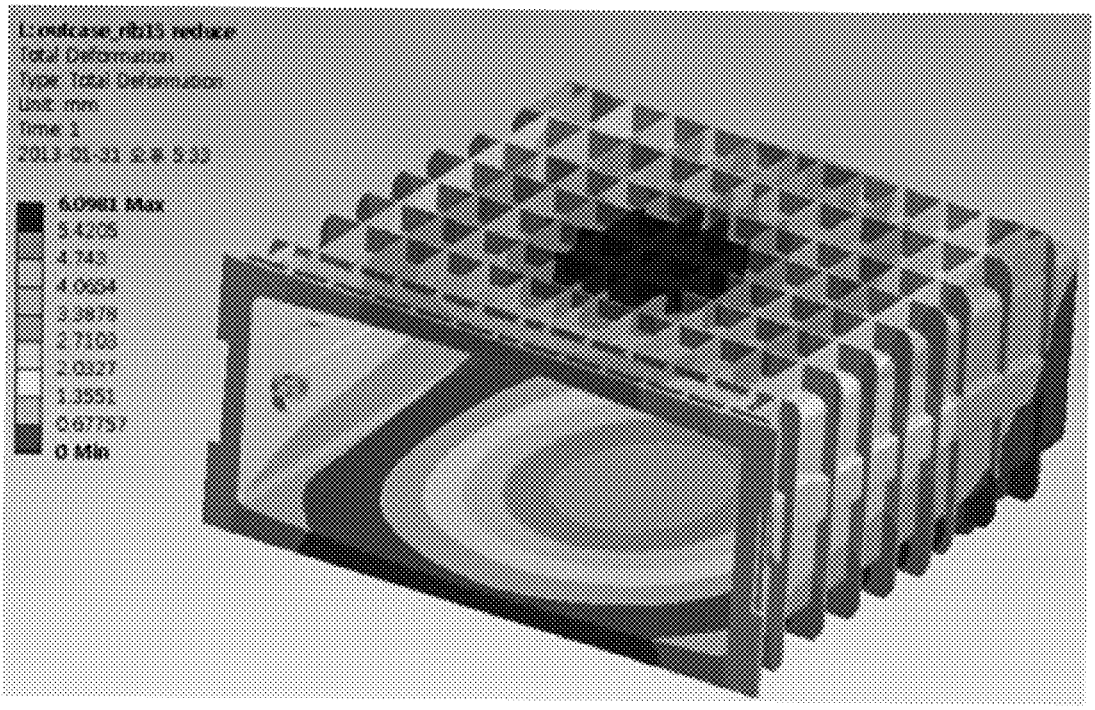
FIG. 17 is a view showing a deformation degree of the case according to the embodiment of the present invention.

FIG. 16 is a view showing a deformation degree of a case according to a comparative example and FIG. 17 is a view showing a deformation degree of the case according to the embodiment of the present invention.

FIG. 16 shows a deformation degree of a case 110 according to a comparative example when negative pressure is generated in the case 110. The edge of the opening 113 is deformed due to the negative pressure in the case 110. In particular, the middle portion of the top surface of the edge of the opening 113 is greatly deformed by 13.22 mm. In this case, contact between the flange 119 of the opening 113 and the drawer 120 is released and external air is introduced into the case 110. Consequently, it is difficult to maintain the interior of the case 110 in a negative pressure state.

FIG. 17 shows a deformation degree of the case 110 according to embodiment of the present invention when negative pressure is generated in the case 110. In the same negative pressure as in the comparative example, the middle portion of the top surface of the edge of the opening 113 is deformed by about 1.5 mm. As a result, contact between the flange 119 of the opening 113 and the drawer 120 is maintained and external air is not introduced into the case 110. Consequently, it is possible to maintain the interior of the case 110 in a negative pressure state and to store vegetables in the case 110 in a fresh state.

Figure 18:
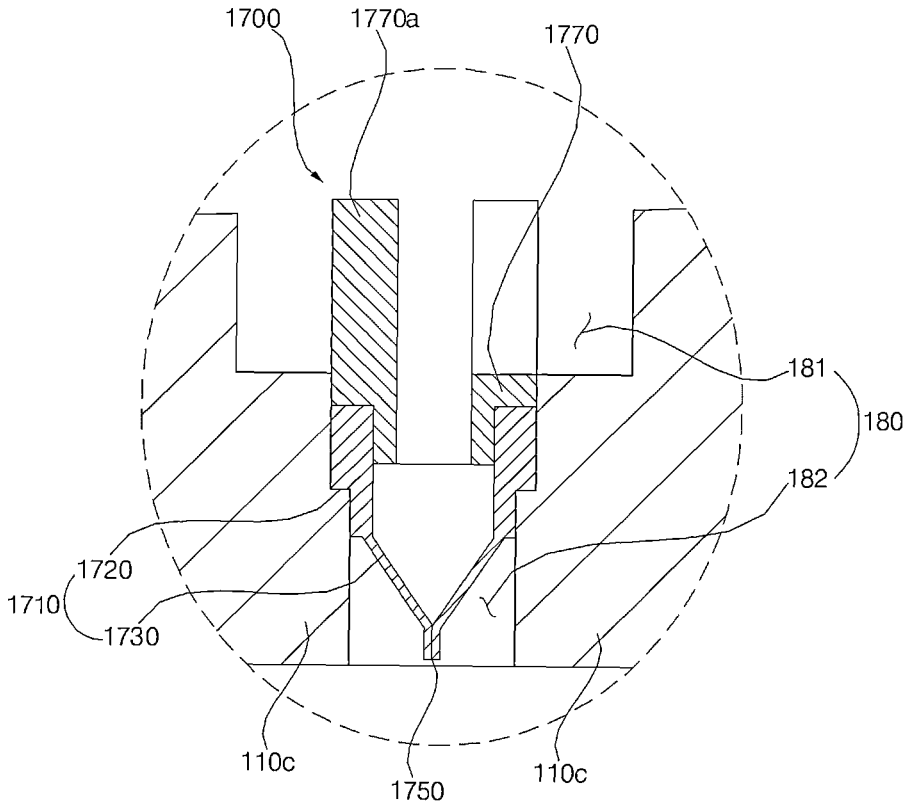
FIG. 18 is a sectional view showing an opening and closing valve according to another embodiment of the present invention.
Figure 19:
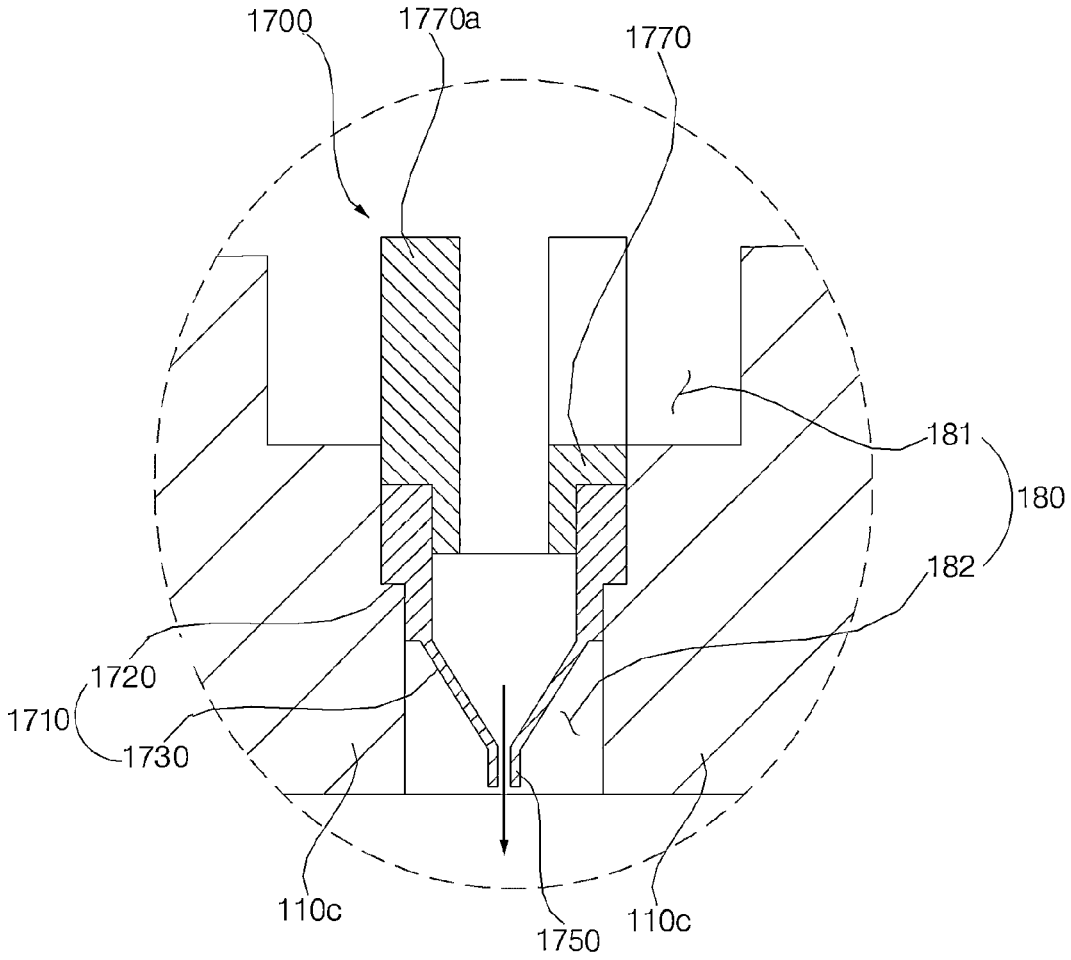
FIG. 19 is a sectional view showing a state in which the opening and closing valve of FIG. 18 is open.
Figure 20:
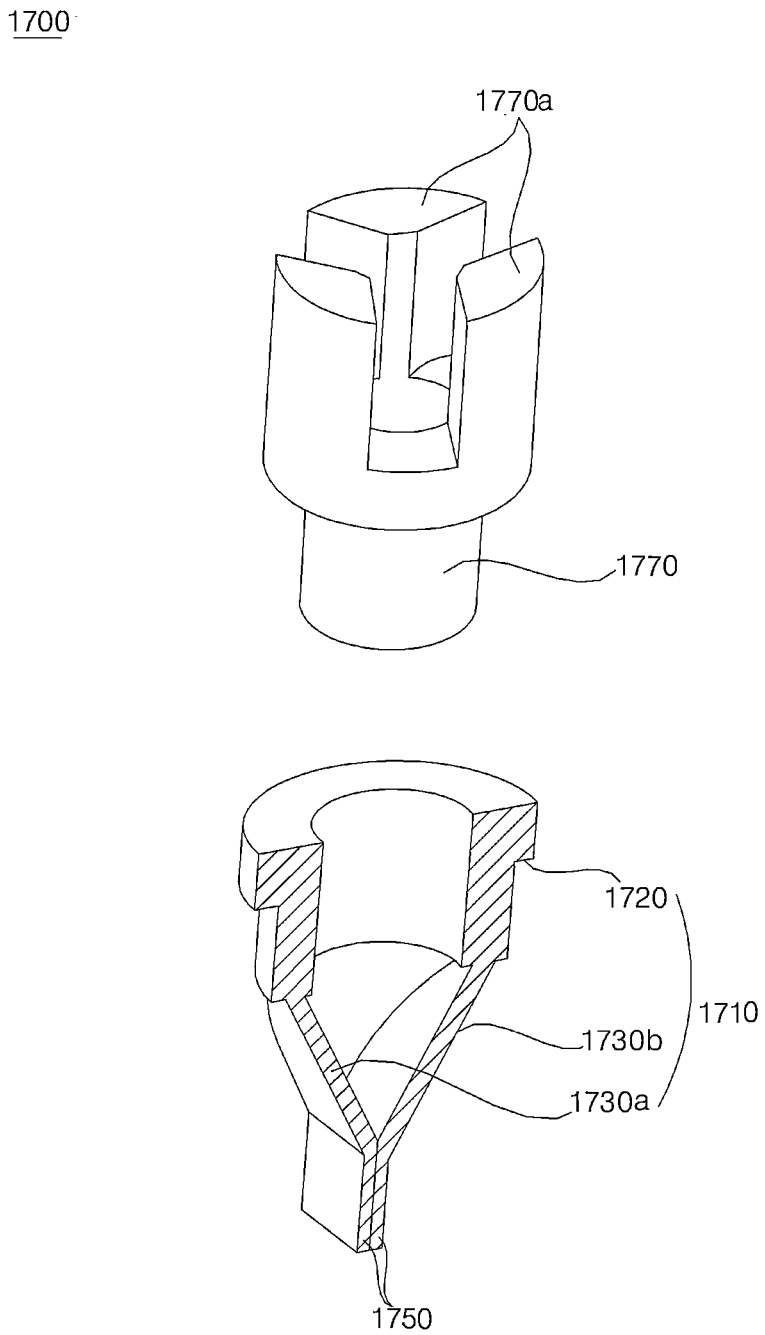
FIG. 20 is a perspective view showing the opening and closing valve according to the embodiment of the present invention shown in FIG. 18.

FIG. 18 is a sectional view showing an opening and closing valve according to another embodiment of the present invention, FIG. 19 is a sectional view showing a state in which the opening and closing valve of FIG. 18 is open, and FIG. 20 is a perspective view showing the opening and closing valve according to the embodiment of the present invention shown in FIG. 18.

Referring to FIGS. 18 to 20, a vegetable container 100 for refrigerators according to another embodiment of the present invention may include a case 110, a drawer 120, a discharge port 180, and an opening and closing valve 1700.

The discharge port 180 may include a water collection part 181 and a discharge part 182. Directions hereinafter mentioned are based on FIGS. 18 and 19.

As shown in FIG. 18, the discharge port 180 is a hole formed through the bottom surface 110*c* of the case 110. The shape of the discharge port 180 is not particularly restricted. The discharge port 180 may have various shapes so long as the discharge port 180 provides a water discharge channel. However, the discharge port 180 may have a shape corresponding to the opening and closing valve 1700 such that the opening and closing valve 1700 is located in the discharge port 180.

The water collection part 181 may be depressed in a portion of the bottom surface 110*c* of the case 110 to collect water in the case 110. The water collection part 181 is a part to which water formed in the case 110 flows along the inner surface of the case 110 to collect at the water collection part 181.

The discharge part 182 allows the water collection part 181 to communicate with the outside of the case 110 such that the water collected at the water collection part 181 can be discharged out of the case 110. The discharge part 182 may have a smaller width than the water collection part 181. The width means a length in the left and right direction in FIG. 18. In addition, the discharge part 182 may have a smaller size or inner diameter than the water collection part 181.

More specifically, the water collection part 181 and the discharge part 182 may each be formed in the shape of a hole. The water collection part 181 and the discharge part 182 may have the same central axis. The outer diameter of the water collection part 181 may be greater than the outer diameter of the discharge part 182. That is, the water collection part 181 may be depressed in a portion of the bottom surface 110*c* of the case 110 and the discharge part 182 may be formed through the bottom surface of the water collection part 181 such that the discharge part 182 communicates with the outside of the case 110.

The inner diameter or width of the water collection part 181 may be uniform. Alternatively, the water collection part 181 may have a step by which a catching protrusion of a fixing part, which will hereinafter described, is caught.

For example, the discharge part 182 may be a through hole formed through the bottom of the water collection part 181.

In this embodiment, the opening and closing valve 1700 is mounted in the discharge port 180 to open and close the discharge port 180. The opening and closing valve 1700 may be closed when there is a difference in pressure between the inside and the outside of the case 110 and may be opened when the difference in pressure between the inside and the outside of the case 110 is released such that there is no difference in pressure or the difference in pressure is minimal. The opening and closing valve 1700 may be made of a material that can be deformed by the difference in pressure between the inside and the outside of the case 110. For example, the opening and closing valve 1700 may be made of rubber or silicone exhibiting ductility and elasticity.

For example, the opening and closing valve 1700 may include a fixing part 1710 and tight contact lips 1750.

The fixing part 1710 has a space, through which water is discharged, defined therein. The fixing part 1710 is inserted and fixed in the discharge port 180. That is, the fixing part 1710 may have an external shape corresponding to an internal shape of the discharge port 180. The space of the fixing part 1710, through which water is discharged, may have various shapes. The fixing part 1710 may be fixed in the discharge port 180.

For example, in a case in which the discharge port 180 has a cylindrical shape, the external shape of the fixing part 1710 may be a cylindrical shape corresponding to the inner diameter of the discharge port 180. In addition, the water discharge space is defined in the fixing part 1710.

The fixing part 1710 may include a catching protrusion 1720 caught by the discharge port 180 and a distance maintaining part 1730 connected to the two tight contact lips 1750 to maintain the distance between the tight contact lips 1750.

The opening and closing valve 1700 is caught by the discharge port 180 through the catching protrusion 1720. Since the opening and closing valve 1700 may be manufactured separately from the case 110 and then inserted into the discharge port 180 formed in the case 110, a fixing means is needed when the opening and closing valve 1700 is inserted into the discharge port 180. The catching protrusion 1720 is caught by the step formed in the discharge port 180 to fix the opening and closing valve 1700 in the discharge port 180.

The catching protrusion 1720 may has an enlarged size at the outer circumference of the fixing part 1710 such that the fixing part 1710 has a single step.

The catching protrusion 1720 is coupled to the step formed in the discharge port 180. The position of the step is not particularly restricted. For example, as shown in FIG. 18, the step may protrude from a portion of the interior of the discharge part 182.

The distance maintaining part 1730 is connected to the two tight contact lips 1750 to maintain the distance between the tight contact lips 1750. That is, the distance maintaining part 1730 is connected between the two tight contact lips 1750 and the catching protrusion 1720 such that the distance between the tight contact lips 1750 is uniform. That is, in a case in which the interior of the case 110 is maintained in a low vacuum state, the distance maintaining part 1730 may be deformed by the difference in pressure between the inside and the outside of the case 110 with the result that the two tight contact lips 1750 may come into contact with each other. On the other hand, in a case in which the low vacuum state of the interior of the case 110 is released, the two tight contact lips 1750 may become spaced apart from each other due to weight or elasticity of the tight contact lips 1750 and the distance maintaining part 1730.

For example, the distance maintaining part 1730 may have at least two inclined surfaces 1730*a* and 1730*b*, the distance between which is gradually decreased from the catching protrusion 1720 to the tight contact lips 1750. That is, the distance maintaining part 1730 may have at least two inclined surfaces 1730*a* and 1730*b* such that the distance maintaining part 1730 is formed in a hopper shape having a water discharge channel defined therein.

That is, the distance maintaining part 1730 may have at least two inclined surfaces 1730*a* and 1730*b*, the distance between which is gradually decreased from the inside of the case 110 to the outside of the case 110.

When the drawer 120 is closed, the interior of the case 110 is maintained in a low vacuum state in which the pressure inside the case 110 is lower than the pressure outside the case 110. On the other hand, when the drawer 120 is opened, the pressure inside the case 110 becomes the atmospheric pressure which is equal to the pressure outside the case 110. Consequently, the distance maintaining part 1730 may have at least two inclined surfaces 1730*a* and 1730*b*, which exhibit uniform rigidity and the distance between which is gradually decreased from the inside of the case 110 and the outside of the case 110, to prevent the tight contact lips 1750, which are in a tight contact state due to great difference in pressure between the inside of the case 110 and the outside of the case 110, from being opened when the drawer 120 is closed.

The two inclined surfaces 1730*a* and 1730*b* deform the shape of the water discharge channel defined in the distance maintaining part 1730 into a slit shape when viewed from above (see FIGS. 18 and 19). That is, the distance between the two inclined surfaces 1730*a* and 1730*b* adjacent to the tight contact lips 1750 is small and the width between the front and the rear of the inclined surfaces 1730*a* and 1730*b* is relatively greater than the distance between the two inclined surfaces 1730*a* and 1730*b*. Consequently, the shape of the water discharge channel defined in the distance maintaining part 1730 becomes a slit shape having a narrow and long gap.

When the shape of the water discharge channel defined in the distance maintaining part 1730 becomes a slit shape due to the two inclined surfaces 1730*a* and 1730*b*, the two tight contact lips 1750 coupled to the lower ends of the inclined surfaces 1730*a* and 1730*b* becomes spaced apart from each other in a state in which a narrow and long gap is defined between the tight contact lips 1750. When the difference in pressure between the inside and the outside of the case 110 is generated, the two tight contact lips 1750 may easily contact each other with the result that it is possible to secure a large contact area. That is, the two tight contact lips 1750, each of which is formed in the shape of a plate, may be spaced apart from each other in a state in which a narrow gap is provided between the tight contact lips 1750 by the two inclined surfaces 1730*a* and 1730*b*.

Meanwhile, in a case in which the channel defined in the distance maintaining part 1730 is too wide, it may be difficult to achieve contact between the tight contact lips 1750 due to the difference in pressure between the inside and the outside of the case 110 with the result that external air may be introduced into the case 110. On the other hand, in a case in which the channel defined in the distance maintaining part 1730 is too narrow, it is not possible to easily discharge water in the case 110 to the outside. Since the channel defined in the distance maintaining part 1730 has a narrow and long slit shape due to the two inclined surfaces 1730*a* and 1730*b*, it is possible to provide a sufficient space, through which water is discharged, in the case 110 while increasing contact force between the tight contact lips 1750.

The distance between the two inclined surfaces 1730*a* and 1730*b* adjacent to the tight contact lips 1750 is set considering low vacuum pressure in the case 110 and weight of the distance maintaining part 1730 and the tight contact lips 1750. That is, the distance between the lower parts of the two inclined surfaces 1730*a* and 1730*b* is set to provide a sufficient space, through which water is discharged, in the case 110 while increasing contact force between the tight contact lips 1750.

The tight contact lips 1750 are connected to the lower part of the fixing part 1710 such that the tight contact lips 1750 can come into tight contact with each other due to the difference in pressure between the inside and the outside of the case 110.

For example, the tight contact lips 1750 may be connected to the inclined surfaces 1730*a* and 1730*b* of the distance maintaining part 1730 such that the tight contact lips 1750 are spaced apart from each other by a predetermined distance. Each of the tight contact lips 1750 may be formed in the shape of a plate.

Each of the tight contact lips 1750 may be made of a deformable material such that the tight contact lips 1750 come into tight contact with each other to close the opening and closing valve 1700 when the pressure inside the case 110 is lower than the pressure outside the case 110 and the tight contact lips 1750 become spaced apart from each other to open the opening and closing valve 1700 when the difference in pressure between the inside and the outside of the case 110 is released.

That is, the two tight contact lips 1750 are spaced apart from each other by a slit type distance due to the two inclined surfaces 1730*a* and 1730*b*. That is, in a case in which the interior of the case 110 is in a low vacuum state, the distance maintaining part 1730 may be deformed or the tight contact lips 1750 may be partially deformed due to the difference in pressure between the inside and the outside of the case 110 with the result that the two tight contact lips 1750 may come into contact with each other. On the other hand, in a case in which the low vacuum state of the interior of the case 110 is released, the two tight contact lips 1750 may become spaced apart from each other due to weight of the tight contact lips 1750 and the distance maintaining part 1730.

For example, the two tight contact lips 1750 may be disposed so as to correspond to each other such that the tight contact lips 1750 can come into surface contact with each other. Each of the tight contact lips 1750 may have a sufficient area. Specifically, each of the tight contact lips 1750 may be formed in a plate shape and the tight contact lips 1750 may be disposed such that the largest surfaces of the tight contact lips 1750 face each other.

The two tight contact lips 1750 are disposed at the tips of the two inclined surfaces 1730*a* and 1730*b* in parallel to the inclined surfaces 1730*a* and 1730*b*.

In this embodiment, a shape maintaining part 1770 may be further included to prevent the tight contact lips 1750 from being spaced apart from each other as the result of excessive deformation of the fixing part 1710 of the opening and closing valve 1700 due to excessive difference in pressure between the inside and the outside of the case 110.

The shape maintaining part 1770 has a water discharge space defined therein. The shape maintaining part 1770 is inserted into the fixing part 1710 from above the fixing part 1710 to maintain the shape of the fixing part 1710.

For example, the shape maintaining part 1770 may have an outer diameter corresponding to the inner diameter of the fixing part 1710, which is formed in a cylindrical shape. In addition, the shape maintaining part 1770 may exhibit higher rigidity than the opening and closing valve 1700.

The shape maintaining part 1770 may be provided with an introduction preventing protrusion 1770*a* to prevent foreign matter in the case 110 from being introduced into the fixing part 1710.

A plurality of introduction preventing protrusions 1770*a* is disposed at the outer circumference of the upper end of the shape maintaining part 1770 while protruding upward in a state in which the introduction preventing protrusions 1770*a* are spaced apart from each other by a predetermined distance. The distance between the respective introduction preventing protrusions 1770*a* adjusts the size of foreign matter introduced into the fixing part 1710 from the interior of the case 110.

The introduction preventing protrusions 1770*a* may protrude upward from the shape maintaining part 1770. More specifically, the introduction preventing protrusions 1770*a* may protrude higher than the bottom surface 110*c* of the case 110. That is, the top surface of each of the introduction preventing protrusions 1770*a* may be disposed higher than the bottom surface 110*c* of the case 110 to prevent introduction of foreign matter into the discharge port 180 formed at the bottom surface 110*c* of the case 110. Of course, in a case in which the water collection part 181 is formed at the discharge port 180, the introduction preventing protrusions 1770*a* may protrude more than the lower surface of the water collection part 181.

The top surface of the shape maintaining part 1770, at which the introduction preventing protrusions 1770*a* are not formed, may have a lower height than or the same height as the bottom surface 110*c* of the case 110 such that water in the case 110 can be introduced into the opening and closing valve 1700.

In this embodiment, in a case in which the drawer 120 is closed and, therefore, the interior of the case 110 is in a low vacuum state, the two tight contact lips 1750 come into tight contact with each other with the result that the low vacuum state of the interior of the case 110 is prevented from being released as the result of the introduction of external air into the case 110. On the other hand, in a case in which the drawer 120 is opened and, therefore, the low vacuum state of the interior of the case 110 is released, the two tight contact lips 1750 become spaced apart from each other with the result that water formed in the case 110 can be discharged out of the case 110. That is, it is possible to discharge water in the case 110 to the outside while maintaining the interior of the case 110 in a low vacuum state through the simple structure without the provision of an additional controller or a drive part.

Hereinafter, operation of the opening and closing valve will be described with reference to FIGS. 18 and 19.

Referring to FIG. 18, the drawer 120 is closed in an initial stage and, therefore, the interior of the case 110 is in a low vacuum state. At this time, force is applied from the outside of the case 110 to the inside of the case 110 due to the difference in pressure between the inside and the outside of the case 110 with the result that the distance between the tight contact lips 1750 and, therefore, the tight contact lips 1750 come into tight contact with each other.

When the tight contact lips 1750 come into tight contact with each other, external air is prevented from being introduced into the case 110 with the result that the low vacuum state of the interior of the case 110 is prevented from being released.

Referring to FIG. 19, when the drawer 120 is opened or the low vacuum state of the interior of the case 110 is released by another means, the difference in pressure between the inside and the outside of the case 110 is released with the result that the tight contact lips 1750 become spaced apart from each other due to weight or elasticity of the distance maintaining part 1730.

When the two tight contact lips 1750 become spaced apart from each other, the opening and closing valve 1700 is opened with the result that water in the case 110 is discharged out of the case 110.

Figure 21:
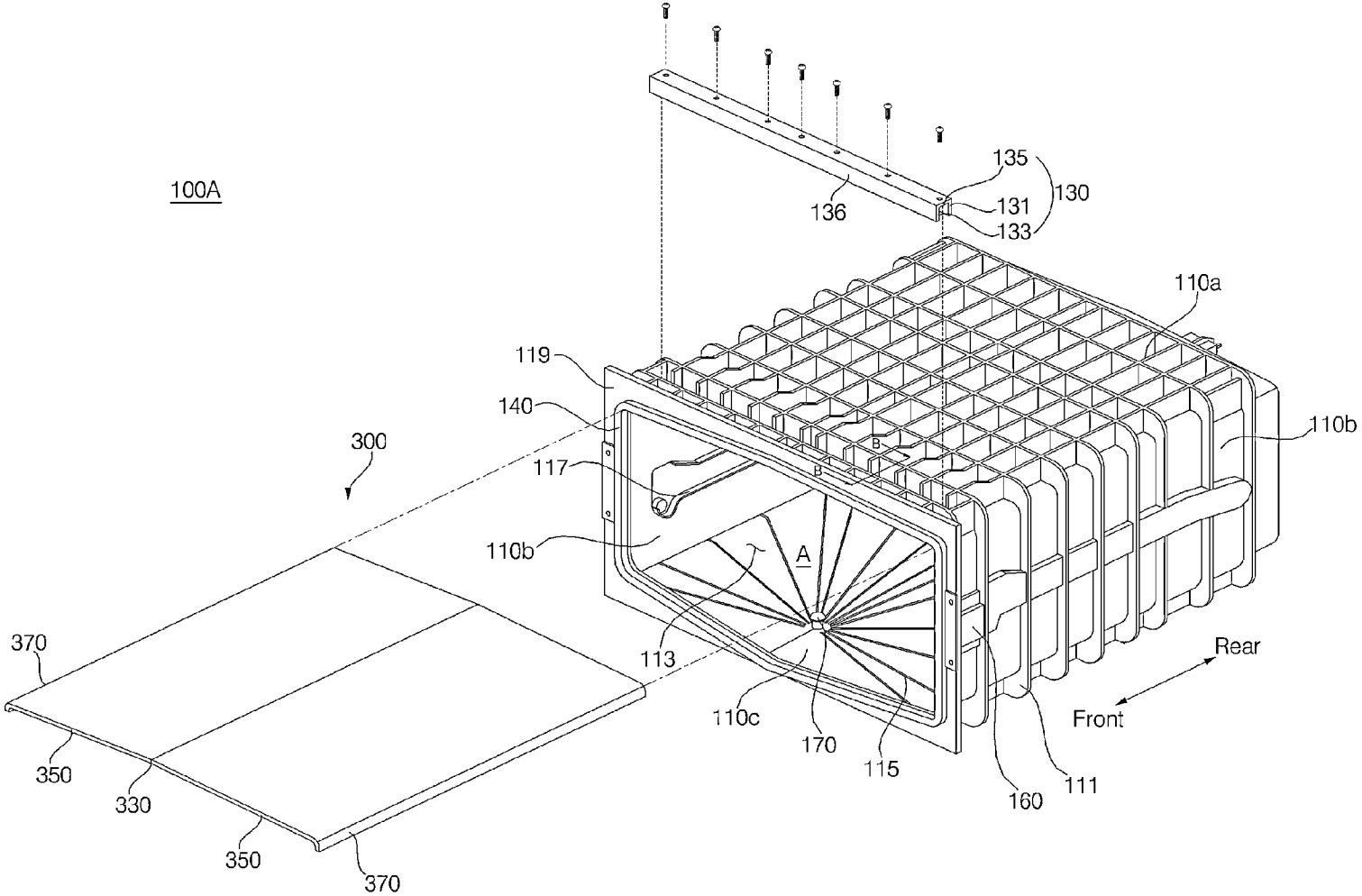
FIG. 21 is an exploded perspective view showing a case according to another embodiment of the present invention.
Figure 22:
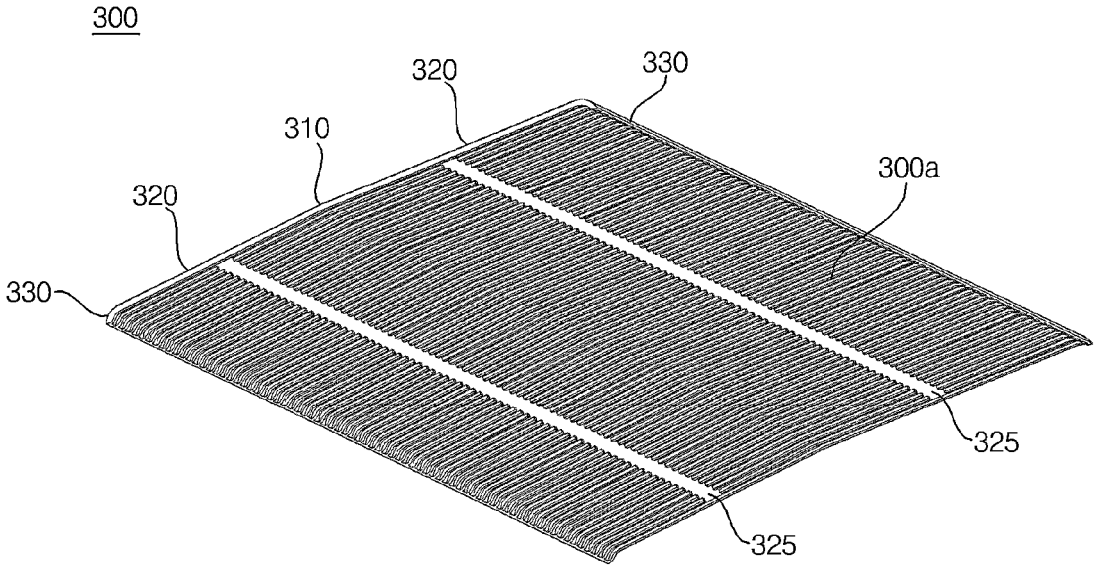
FIG. 22 is a perspective view showing a top inner case of FIG. 21.
Figure 23:
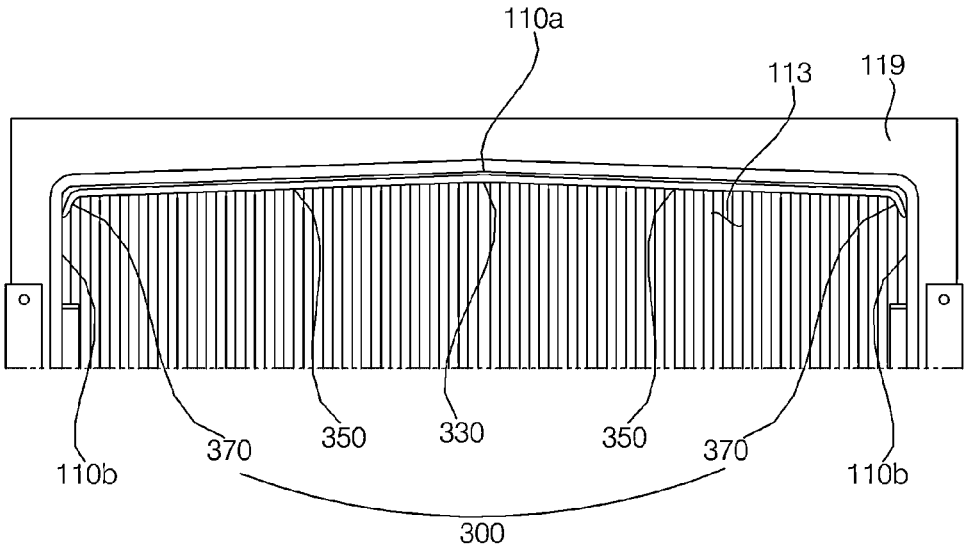
FIG. 23 is a front view showing a state in which the top inner case of the embodiment of the present invention is coupled in the case.

FIG. 21 is an exploded perspective view showing a case according to another embodiment of the present invention, FIG. 22 is a perspective view showing a top inner case of FIG. 21, FIG. 23 is a front view showing a state in which the top inner case of the embodiment of the present invention is coupled in the case, FIG. 24A is a partial plan view of the top inner case according to the embodiment of the present invention when viewed from the interior of the case, and FIG. 24B is a sectional view of the top inner case according to the embodiment of the present invention.

Referring to FIGS. 21 to 23, a vegetable container 100A for refrigerators according to another embodiment of the present invention includes a case 110, a drawer 120, a discharge port 180, a top inner case 300 disposed at the inside of a top surface 110*a* of the case 110, the top inner case 300 being fitted and fixed between lateral surfaces 110*b* of the case 110, top inner guide channels 300*a* formed at the inner surface of the top inner case 300 to guide water formed in the case 110 (on the inner surface of the top inner case 300) to the discharge port 180, and discharge valves 170 and 1700.

The case 110, the drawer 120, and the discharge port 180 are identical to those of the embodiment shown in FIG. 3 and, therefore, a description thereof will be omitted.

The top inner case 300 is disposed at the inside of the top surface 110*a* of the case 110. The top inner case 300 is fitted and fixed between the lateral surfaces 110*b* of the case 110.

The width of the top inner case 300 is slightly greater than the width between the lateral surfaces 110*b* of the case 110 such that the top inner case 300 can be fitted and fixed between the lateral surfaces 110*b* of the case 110 by elastic restoring force of the top inner case 300.

For example, the top inner case 300 may include a middle part 330 located at the middle thereof, two inclined parts 350 extending from the middle part 330 to the lateral surfaces 110*b* of the case 110 while being inclined downward, and edge parts 370 bent downward from the inclined parts 350 such that the edge parts 370 can come into tight contact with the lateral surfaces 110*b* of the case 110 by elastic force.

The middle part 330 may define the middle of the top inner case 300.

The two inclined parts 350 extend from the middle part 330 to the lateral surfaces 110*b* of the case 110. In addition, the two inclined parts 350 are inclined downward from the middle part 330 to the lateral surfaces 110*b* of the case 110 such that dew formed on the inner surface (bottom surface) of the top inner case 300 can flow to the lateral surfaces 110*b* of the case 110.

Particularly, in a case in which the top inner guide channels 300*a* extend in the left and right direction of the case 110, as will hereinafter be described, dew formed in the top inner case 300 can be more easily guided to the lateral surfaces 110*b* of the case 110 when the two inclined parts 350 are inclined downward from the middle part 330 to the lateral surfaces 110*b* of the case 110.

The edge parts 370 come into tight contact with the lateral surfaces 110*b* of the case 110 by elastic force to fix the top inner case 300 to the lateral surfaces 110*b* of the case 110.

The edge parts 370 may be bent downward from the respective inclined parts 350 such that the edge parts 370 have elastic force. Water flowing along the inclined parts 350 may be guided to the lateral surfaces 110*b* of the case 110 via the edge parts 370.

More specifically, the edge parts 370 may be rounded. In addition, the thickness of the edge parts 370 may be gradually reduced from the inclined parts 350 to ends of the edge parts 370. In a case in which the thickness of the edge parts 370 is gradually reduced from the inclined parts 350 to the ends of the edge parts 370, water guided from the edge parts 370 to the lateral surfaces 110*b* of the case 110 does not drop into the case 110.

Figure 24:
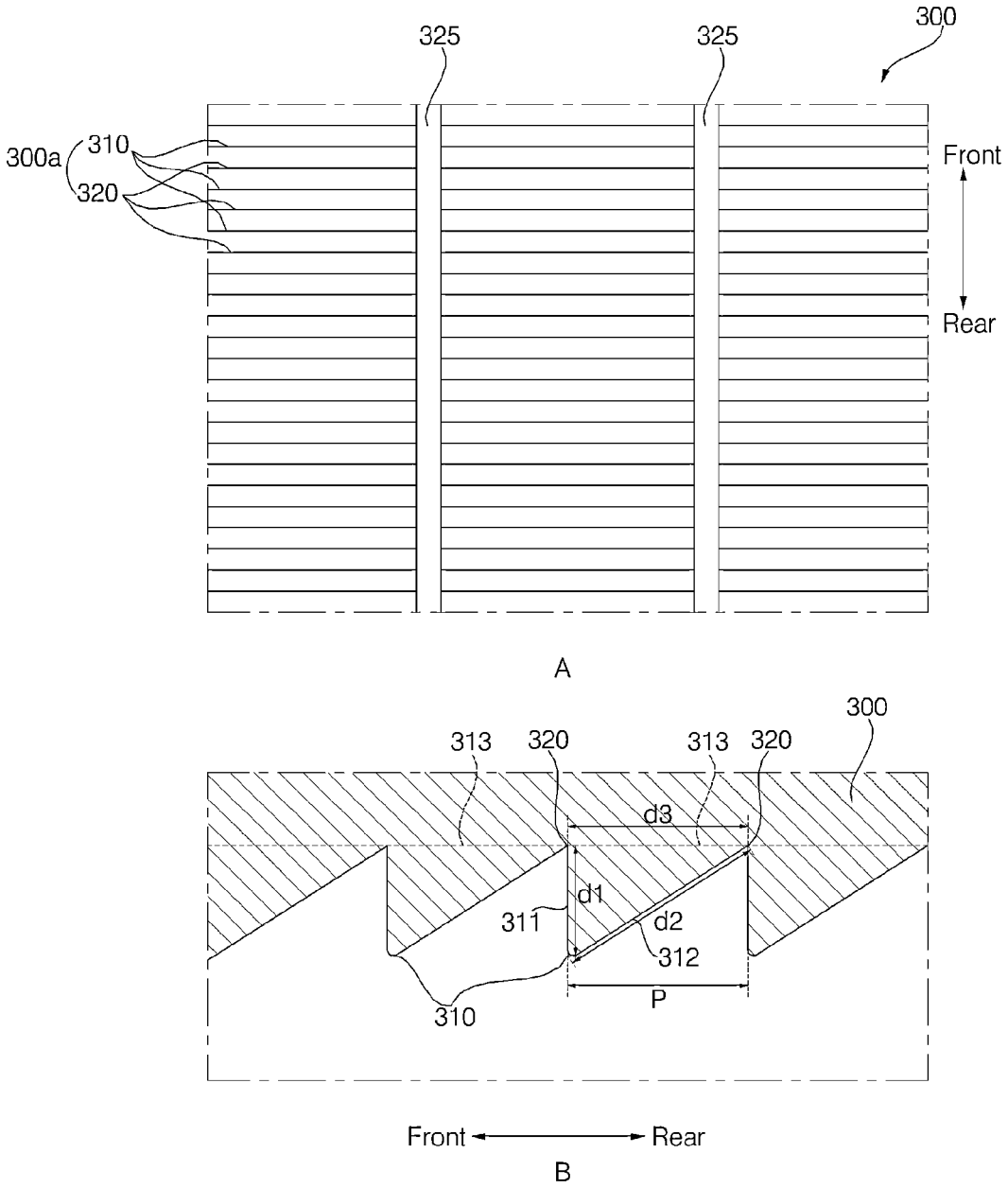
FIG. 24A is a partial plan view of the top inner case according to the embodiment of the present invention when viewed from the interior of the case.
FIG. 24B is a sectional view of the top inner case according to the embodiment of the present invention.

Referring to FIG. 24, the top inner guide channels 300*a* are formed at the inner surface of the top inner case 300 to guide water formed on the inner surface of the top inner case 300 to the discharge port 180. In addition, the top inner guide channels 300*a* serve to hide dew formed in the case 110 such that the dew cannot be observed by the naked eye.

The top inner guide channels 300*a* may be formed at the inner surface (bottom surface) of the top inner case 300. The inner surface of the top inner case 300 means a surface of the top inner case 300 exposed in the case 110 when the top inner case 300 is fitted into the case 110.

The top inner guide channels 300*a* are continuously formed at the middle part 330, the inclined parts 350, and the edge parts 370 of the top inner case 300.

The top inner guide channels 300*a* may be formed at the inner surface of the top inner case 300 in a depressed and protruding fashion to guide water to the discharge port 180 (in the left and right direction of the case 110).

For example, the top inner guide channels 300*a* may include at least two mountain parts 310 protruding toward the inside (lower side) of the top inner case 300 and at least one valley part 320 disposed between the respective mountain parts 310, the valley part 320 being depressed toward the outside (upper side) of the top inner case 300.

The mountain parts 310 extend in the left and right direction of the case 110. A plurality of mountain parts 310 are repeatedly arranged from the front to the rear of the case 110.

The mountain parts 310 are parts protruding more than the valley part 320 such that water formed on the inner surface of the top inner case 300 can flow to the valley part 320. The valley part 320 is formed between the respective mountain parts 310 such that the valley part 320 is lower than the mountain parts 310 to provide a water guide channel.

The mountain parts 310 and the valley parts 320 are alternately arranged from the front to the rear of the case 110. When the temperature in the case 110 is lowered to a dew point or less, moisture in the case 110 may be saturated to form dew. The dew flows from the mountain parts 310 to the valley parts 320 and is stored in the valley parts 320. In particular, the dew does not stay on the protruding mountain parts 310 but moves to the depressed valley parts 320 due to cohesive force of water and adhesive force between the water and the inner surface of the top inner case 300.

In addition, when the dew is stored in the valley parts 320 in a state in which the mountain parts 310 and the valley parts 320 are alternately arranged from the front to the rear of the case 110, a user located in front of the case 110 cannot easily see the dew stored in the valley parts 320. That is, the dew is not visible. This is because the mountain parts 310 extending from the left side to the right side of the case 110 may obstruct the user's field of vision.

Specifically, referring to FIG. 24B, each of the mountain parts 310 may have an approximately right-angled triangular shape as a sectional shape (taken along a line directed from the front to the rear of the case 110).

More specifically, each of the mountain parts 310 may be defined by a first inclined side 311 and a second inclined side 312 extending from opposite ends of a base 313 to form an apex.

The base 313 is an arbitrary line interconnecting adjacent valley parts 320.

A length ratio (d3:d1:d2) of the base 313, the first inclined side 311, and the second inclined side 312 may be 1.4 to 1.6:1.9 to 2.1:2.36 to 2.64. When a Pythagoras theorem is applied, therefore, each of the mountain parts 310 may have an approximately right-angled triangular shape in which an inner angle defined between the base 313 and the first inclined side 311 is approximately 90 degrees as a sectional shape.

The mountain parts 310 and the valley parts 320 are symmetrical with respect to the second inclined side 312.

In a case in which the mountain parts 310 and the valley parts 320 are formed in a quadrangular shape, dew formed on the inner surface of the top inner case 300 cannot easily move to the valley parts 320. Consequently, the dew may stay on the mountain parts 310 with the result that the user may observe the dew.

In a case in which the mountain parts 310 and the valley parts 320 are formed in a triangular shape, dew formed on the inner surface of the top inner case 300 can easily move to the valley parts 320. In particular, the dew formed on the inner surface of the top inner case 300 has a large contact area between the inner surface of the top inner case 300 between the first inclined side 311 and the second inclined side 312. Such a large contact area improves adhesive force with the dew. As a result, the dew can easily move to the valley part 320.

Particularly, in a case in which the mountain parts 310 and the valley parts 320 are formed in a right-angled triangular shape, dew formed on the inner surface of the top inner case 300 can more easily move to the valley parts 320. Specifically, in a case in which an interior angle (an angle between the first inclined side 311 and the second inclined side 312) of each of the valley parts 320 is increased, the dew formed at the apexes of mountain parts 310 cannot easily move to the valley parts 320. On the other hand, in a case in which the interior angle (the angle between the first inclined side 311 and the second inclined side 312) of each of the valley parts 320 is excessively decreased, the height of each of the mountain parts 310 is excessively increased with the result that the strength of the top inner case 300 is lowered and the thickness of the top inner case 300 is increased.

In a case in which the mountain parts 310 and the valley parts 320 are formed in a right-angled triangular shape, therefore, it is necessary to configure the mountain parts 310 and the valley parts 320 such that the interior angle (the angle between the first inclined side 311 and the second inclined side 312) of each of the valley parts 320 is decreased while the height of each of the mountain parts 310 is not excessively increased to improve adhesive force between water and the valley parts 320.

The first inclined side 311 of each of the mountain parts 310 may be located more at the front of the case 110 than the second inclined side 312 of each of the mountain parts 310.

The apex of each of the mountain parts 310 formed by the first inclined side 311 and the second inclined side 312 may be rounded to prevent dew formed at the apex of each of the mountain parts 310 from dropping into the case 110 due to gravity.

In addition, in a case in which the apex of each of the mountain parts 310 formed by the first inclined side 311 and the second inclined side 312 is rounded, it is possible to easily guide the dew formed at the apex of each of the mountain parts 310 to the valley parts 320.

A pitch P between the respective mountain parts 310 may be 1.5 mm to 2.5 mm. In a case in which the pitch P between the respective mountain parts 310 is greater than 2.5 mm, dew formed on the inner surface of the top inner case 300 cannot easily move to the valley parts 320. On the other hand, in a case in which the pitch P between the respective mountain parts 310 is less than 1.5 mm, each of the valley parts 320 cannot provide a sufficient space to collect dew with the result that the dew may be observed by the naked eye.

In addition, each of the mountain parts 310 may have a height of 1.5 mm to 2.5 mm. In a case in which the height of each of the mountain parts 310 is too large, the strength of the top inner case 300 is lowered. On the other hand, in a case in which the height of each of the mountain parts 310 is too small, each of the valley parts 320 cannot provide a sufficient space to collect dew.

Referring back to FIG. 24A, the embodiment of the present invention may further include top inner auxiliary channels 325 intersecting the top inner guide channels 300*a*, the top inner auxiliary channels 325 being depressed in the inner surface of the top inner case 300.

Dew formed on the inner surface of the top inner case 300 moves along the valley parts 320 in the left and right direction of the case 110. Movement of the dew to the front and the rear of the case 110 is restricted by the mountain parts 310. In a case in which the amount of dew formed on the inner surface of the top inner case 300 is excessive, the dew may not spread out along the valley parts 320 but may drop into the case 110.

The top inner auxiliary channels 325 intersect the mountain parts 310 and the valley parts 320 to guide water to adjacent other valley parts 320 in a case in which the amount of dew formed on the inner surface of the top inner case 300 is excessive.

Specifically, the top inner auxiliary channels 325 extend from the front to the rear of the case 110 such that the top inner auxiliary channels 325 communicate with the plural valley parts 320.

Figure 25:
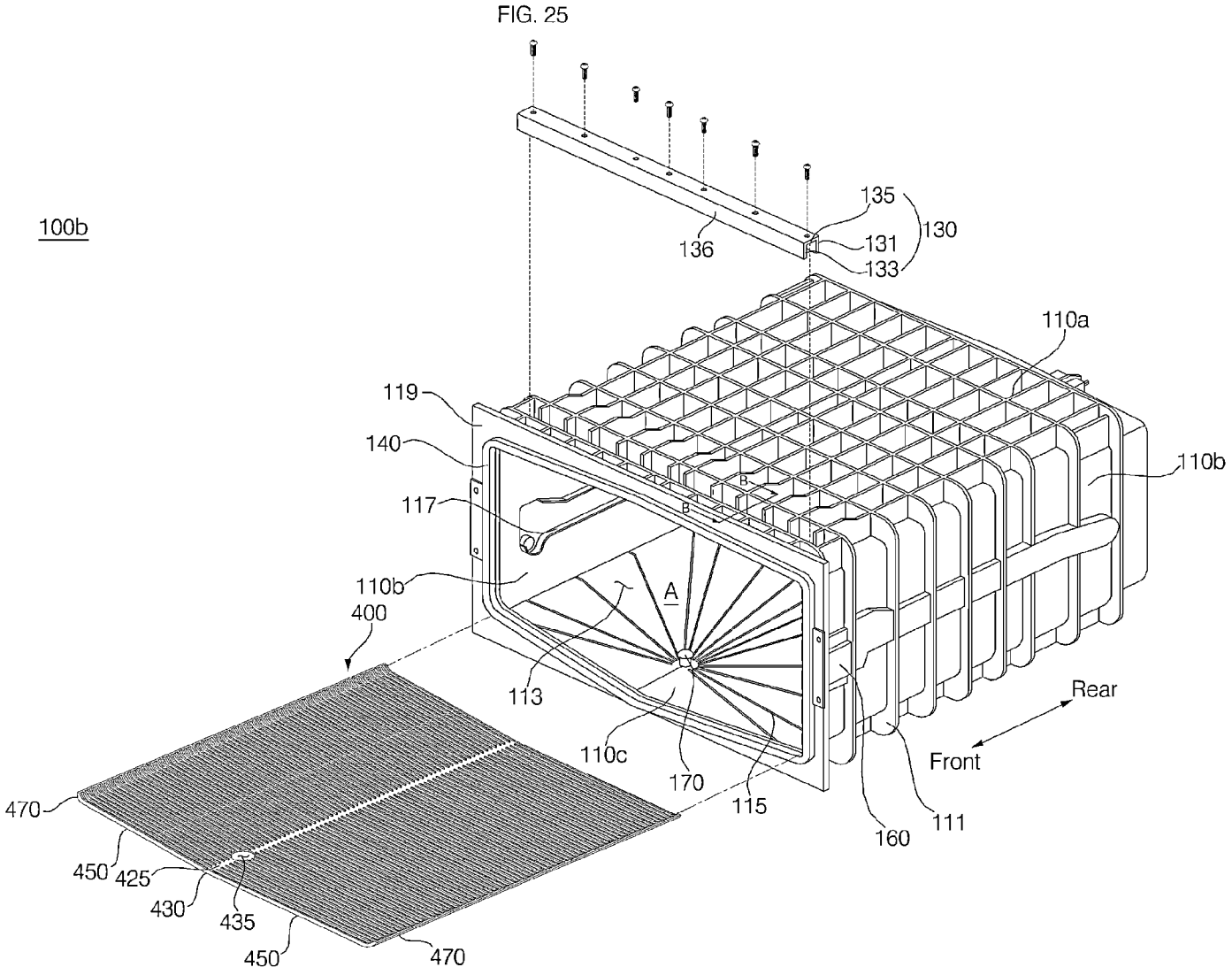
FIG. 25 is an exploded perspective view showing a case according to a further embodiment of the present invention.
Figure 26:
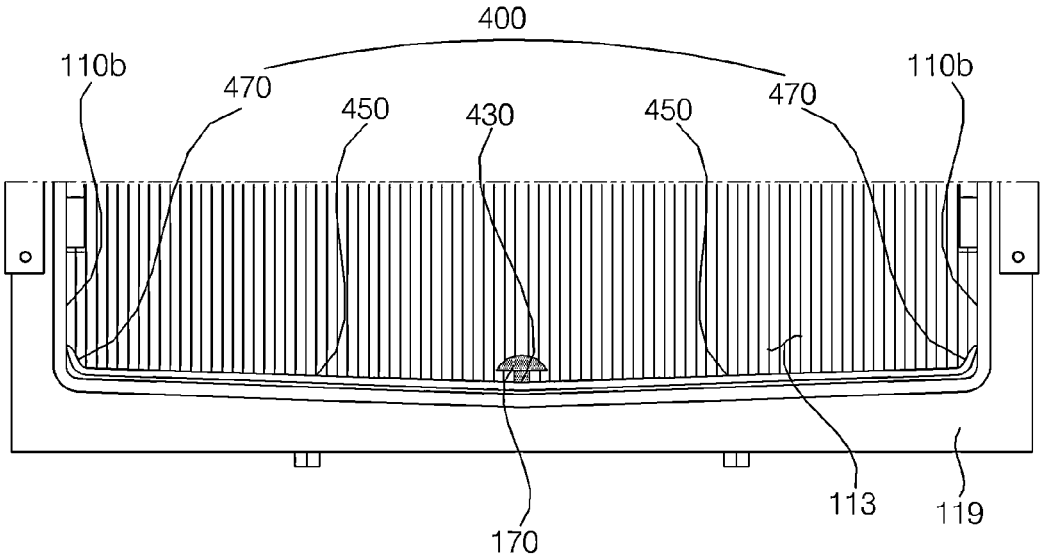
FIG. 26 is a front view showing a state in which a bottom inner case of the embodiment of the present invention is coupled in the case.
Figure 27:
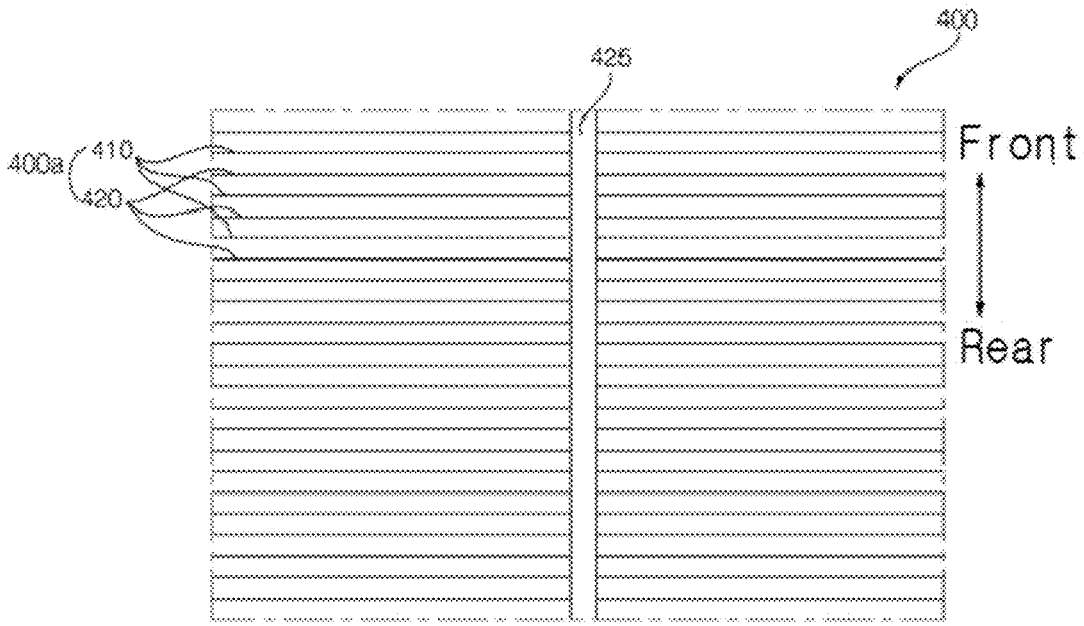
FIG. 27 is a partial plan view of the bottom inner case of FIG. 25 when viewed from the interior of the case.
Figure 28:
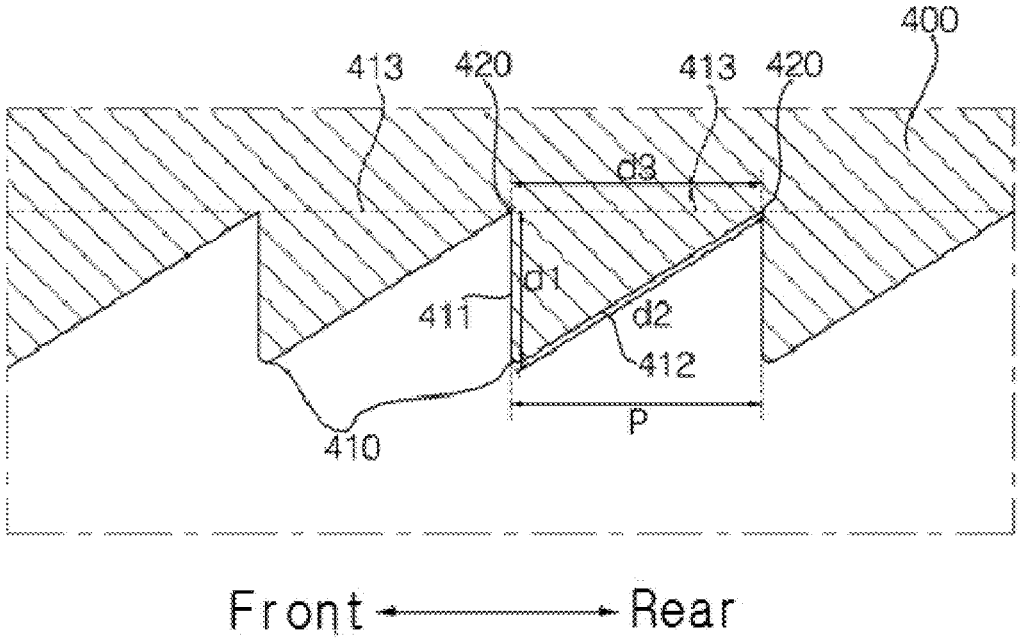
FIG. 28 is a partial sectional view showing the bottom inner case according to the embodiment of the present invention shown in FIG. 27.
Figure 29:
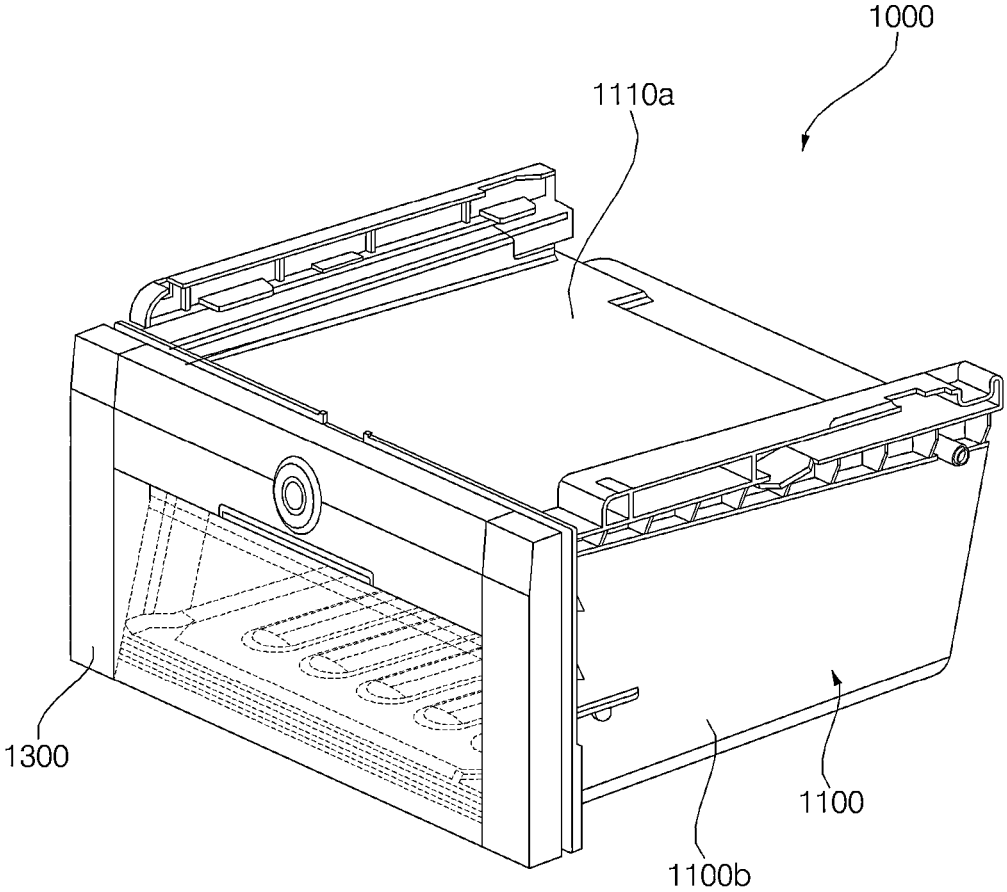
FIG. 29 (Related Art)
FIG. 29 is a perspective view showing a related art vegetable container for refrigerators.

FIG. 25 is an exploded perspective view showing a case according to a further embodiment of the present invention, FIG. 26 is a front view showing a state in which a bottom inner case of the embodiment of the present invention is coupled in the case, FIG. 27 is a partial plan view of the bottom inner case of FIG. 25 when viewed from the interior of the case, and FIG. 28 is a partial sectional view showing the bottom inner case according to the embodiment of the present invention shown in FIG. 27.

Referring to FIGS. 25 and 26, a vegetable container 100B for refrigerators according to a further embodiment of the present invention includes a case 110, a drawer 120, a discharge port 180, a bottom inner case 400 disposed at the inside of a bottom surface 110*c* of the case 110, the bottom inner case 400 being fitted and fixed between lateral surfaces 110*b* of the case 110, top inner guide channels 400*a* formed at the inner surface of the bottom inner case 400 to guide water formed on the inner surface of the bottom inner case 400 to the discharge port 180, and discharge valves 170 and 1700.

The case 110, the drawer 120, and the discharge port 180 are identical to those of the embodiment shown in FIG. 21 and, therefore, a description thereof will be omitted.

The bottom inner case 400 is disposed at the inside of the bottom surface 110*c* of the case 110. The bottom inner case 400 is fitted and fixed between the lateral surfaces 110*b* of the case 110.

The width of the bottom inner case 400 is slightly greater than the width between the lateral surfaces 110*b* of the case 110 such that the bottom inner case 400 can be fitted and fixed between the lateral surfaces 110*b* of the case 110 by elastic restoring force of the bottom inner case 400.

For example, the bottom inner case 400 may include a middle part 430 located at the middle thereof, two slope parts 350 extending from the middle part 430 to the lateral surfaces 110*b* of the case 110 while being inclined upward, and wing parts 470 bent upward from the slop parts 450 such that the wing parts 470 can come into tight contact with the lateral surfaces 110*b* of the case 110 by elastic force.

The middle part 430 may define the middle of the bottom inner case 400.

The two slope parts 450 extend from the middle part 430 to the lateral surfaces 110*b* of the case 110. In addition, the two slope parts 450 are inclined upward from the middle part 430 to the lateral surfaces 110*b* of the case 110 such that dew formed on the inner surface (top surface) of the bottom inner case 400 can flow to the middle part 430.

Particularly, in a case in which the bottom inner guide channels 400*a* extend in the left and right direction of the case 110, as will hereinafter be described, dew can be more easily guided to the middle part 430 when the two slope parts 450 are inclined downward from the lateral surfaces 110*b* of the case 110 to the middle part 430.

The wing parts 470 come into tight contact with the lateral surfaces 110*b* of the case 110 by elastic force to fix the bottom inner case 400 to the lateral surfaces 110*b* of the case 110.

The wing parts 470 may be bent upward from the respective slope parts 450 such that the wing parts 470 have elastic force. Water flowing along the lateral surfaces 110*b* of the case 110 may be guided to the slope parts 450 via the wing parts 470.

More specifically, the wing parts 470 may be rounded. In addition, the thickness of the wing parts 470 may be gradually reduced from the slope parts 450 to ends of the wing parts 470. In a case in which the thickness of the wing parts 470 is gradually reduced from the slope parts 450 to the ends of the wing parts 470, water guided from the lateral surfaces 110*b* of the case 110 to the wing parts 470 does not drop into the case 110.

In addition, the bottom inner case 400 may further include a through hole 435, through which the discharge valve 170 is disposed.

The through hole 435 is formed so as to correspond to the discharge valve 170 such that the discharge valve 170 is disposed through the through hole 435. The through hole 435 provides a space through which water flowing on the top surface of the bottom inner case 400 drops to a water collection part.

Specifically, the through hole 435 may be located at the middle part 430.

Referring to FIGS. 27 and 28, the bottom inner guide channels 400*a* may guide water formed on the inner surface (top surface) of the bottom inner case 400 to the discharge port 180.

The bottom inner guide channels 400*a* are formed at the inner surface (top surface) of the bottom inner case 400 to guide water formed on the top surface of the bottom inner case 400 to the discharge port 180. In addition, the bottom inner guide channels 400*a* serve to hide dew formed on the inner surface (top surface) of the bottom inner case 400 such that the dew cannot be observed by the naked eye.

The bottom inner guide channels 400*a* may be formed at the inner surface (top surface) of the bottom inner case 400. The inner surface of the bottom inner case 400 means a surface of the bottom inner case 400 exposed in the case 110 when the bottom inner case 400 is fitted into the case 110.

The bottom inner guide channels 400*a* are continuously formed at the middle part 430, the slope parts 450, and the wing parts 470 of the bottom inner case 400.

The bottom inner guide channels 400*a* may be formed at the inner surface of the bottom inner case 400 in a depressed and protruding fashion to guide water to the discharge port 180 (in the left and right direction of the case 110).

For example, the bottom inner guide channels 400*a* may include at least two mountain parts 410 protruding toward the inside (upper side) of the bottom inner case 400 and at least one valley part 420 disposed between the respective mountain parts 410, the valley part 420 being depressed toward the outside (lower side) of the bottom inner case 400.

The mountain parts 410 extend in the left and right direction of the case 110. A plurality of mountain parts 410 are repeatedly arranged from the front to the rear of the case 110.

The mountain parts 410 are parts protruding more than the valley part 420 such that water formed on the inner surface of the bottom inner case 400 can flow to the valley part 420. The valley part 420 is formed between the respective mountain parts 410 such that the valley part 420 is lower than the mountain parts 410 to provide a water guide channel.

The mountain parts 410 and the valley parts 420 are alternately arranged from the front to the rear of the case 110. When the temperature in the case 110 is lowered to a dew point or less, moisture in the case 110 may be saturated to form dew. The dew flows from the mountain parts 410 to the valley parts 420 and is stored in the valley parts 420. In particular, the dew does not stay on the protruding mountain parts 410 but moves to the depressed valley parts 420 due to cohesive force of water and adhesive force between the water and the inner surface of the bottom inner case 400.

In addition, when the dew is stored in the valley parts 420 in a state in which the mountain parts 410 and the valley parts 420 are alternately arranged from the front to the rear of the case 110, a user located in front of the case 110 cannot easily see the dew stored in the valley parts 420. That is, the dew is not visible. This is because the mountain parts 410 extending from the left side to the right side of the case 110 may obstruct the user's field of vision.

Specifically, referring to FIG. 28, each of the mountain parts 410 may have an approximately right-angled triangular shape as a sectional shape (taken along a line directed from the front to the rear of the case 110).

More specifically, each of the mountain parts 410 may be defined by a first inclined side 411 and a second inclined side 412 extending from opposite ends of a base 413 to form an apex.

The base 413 is an arbitrary line interconnecting adjacent valley parts 420.

A length ratio (d3:d1:d2) of the base 413, the first inclined side 411, and the second inclined side 412 may be 1.4 to 1.6:1.9 to 2.1:2.36 to 2.64. When a Pythagoras theorem is applied, therefore, each of the mountain parts 310 may have an approximately right-angled triangular shape in which an inner angle defined between the base 413 and the first inclined side 411 is approximately 90 degrees as a sectional shape.

The mountain parts 410 and the valley parts 420 are symmetrical with respect to the second inclined side 412.

In a case in which the mountain parts 410 and the valley parts 420 are formed in a quadrangular shape, dew formed on the inner surface of the bottom inner case 400 cannot easily move to the valley parts 420. Consequently, the dew may stay on the mountain parts 410 with the result that the user may observe the dew.

In a case in which the mountain parts 410 and the valley parts 420 are formed in a triangular shape, dew formed on the inner surface of the bottom inner case 400 can easily move to the valley parts 420. In particular, the dew formed on the inner surface of the bottom inner case 400 has a large contact area between the inner surface of the bottom inner case 400 between the first inclined side 411 and the second inclined side 412. Such a large contact area improves adhesive force with the dew. As a result, the dew can easily move to the valley part 420.

Particularly, in a case in which the mountain parts 410 and the valley parts 420 are formed in a right-angled triangular shape, dew formed on the inner surface of the bottom inner case 400 can more easily move to the valley parts 420. Specifically, in a case in which an interior angle (an angle between the first inclined side 411 and the second inclined side 412) of each of the valley parts 420 is increased, the dew formed at the apexes of mountain parts 410 cannot easily move to the valley parts 420. On the other hand, in a case in which the interior angle (the angle between the first inclined side 411 and the second inclined side 412) of each of the valley parts 420 is excessively decreased, the height of each of the mountain parts 410 is excessively increased with the result that the strength of the bottom inner case 400 is lowered and the thickness of the bottom inner case 400 is increased.

In a case in which the mountain parts 410 and the valley parts 420 are formed in a right-angled triangular shape, therefore, it is necessary to configure the mountain parts 410 and the valley parts 420 such that the interior angle (the angle between the first inclined side 411 and the second inclined side 412) of each of the valley parts 420 is decreased while the height of each of the mountain parts 410 is not excessively increased to improve adhesive force between water and the valley parts 420.

The first inclined side 411 of each of the mountain parts 410 may be located more at the front of the case 110 than the second inclined side 412 of each of the mountain parts 410.

The apex of each of the mountain parts 410 formed by the first inclined side 411 and the second inclined side 412 may be rounded to prevent dew formed at the apex of each of the mountain parts 410 from dropping into the case 110 due to gravity. In addition, in a case in which the apex of each of the mountain parts 410 formed by the first inclined side 411 and the second inclined side 412 is rounded, it is possible to easily guide the dew formed at the apex of each of the mountain parts 410 to the valley parts 420.

A pitch P between the respective mountain parts 410 may be 1.5 mm to 2.5 mm. In a case in which the pitch P between the respective mountain parts 410 is greater than 2.5 mm, dew formed on the inner surface of the bottom inner case 400 cannot easily move to the valley parts 420. On the other hand, in a case in which the pitch P between the respective mountain parts 410 is less than 1.5 mm, each of the valley parts 420 cannot provide a sufficient space to collect dew with the result that the dew may be observed by the naked eye.

In addition, each of the mountain parts 410 may have a height of 1.5 mm to 2.5 mm. In a case in which the height of each of the mountain parts 410 is too large, the strength of the bottom inner case 400 is lowered. On the other hand, in a case in which the height of each of the mountain parts 410 is too small, each of the valley parts 420 cannot provide a sufficient space to collect dew.

Referring back to FIG. 27, the embodiment of the present invention may further include bottom inner auxiliary channels 425 intersecting the bottom inner guide channels 400*a*, the bottom inner auxiliary channels 425 being depressed in the inner surface of the bottom inner case 400.

Dew formed on the inner surface of the bottom inner case 400 moves along the valley parts 420 in the left and right direction of the case 110. Movement of the dew to the front and the rear of the case 110 is restricted by the mountain parts 410. In a case in which the amount of dew formed on the inner surface of the bottom inner case 400 is excessive, the dew may not spread out along the valley parts 420 but may drop into the case 110.

The bottom inner auxiliary channels 425 intersect the mountain parts 410 and the valley parts 420 to guide water to adjacent other valley parts 420 in a case in which the amount of dew formed on the inner surface of the bottom inner case 400 is excessive.

In addition, the bottom inner auxiliary channels 425 serve to guide the water stored in the valley parts 420 to the though hole 435. The water guided to the though hole 435 drops to the discharge port 180.

Specifically, the bottom inner auxiliary channels 425 extend from the front to the rear of the case 110 such that the bottom inner auxiliary channels 425 communicate with the valley parts 420. In addition, the bottom inner auxiliary channels 425 may communicate with the though hole 435.

As is apparent from the above description, the refrigerator according to the embodiments of the present invention has one or more of the following effects.

One effect is that the edge of an opening of a case is designed to have an arch structure to prevent the circumference of the opening of the case from being bent inside the case.

In addition, another effect is that a flange is formed at the edge of the opening to prevent the edge of the opening from drooping and to provide a contact surface between a hermetical sealing member and a drawer.

In addition, another effect is that a reinforcing member is coupled adjacent to the edge of the opening to reduce deformation of the edge of the opening.

In addition, another effect is that deformation of the edge of the opening is restrained, whereby it is possible to continuously maintain the interior of a vegetable container in a low vacuum state.

In addition, another effect is that dew formed on the inner surface of the case moves to valley parts along guide channels formed at the inner surface of the case, whereby the dew cannot be observed by the naked eye.

In addition, another effect is that the top surface of the case is inclined downward to lateral surfaces of the case, whereby dew formed on the top surface of the case can be effectively guided to the lateral surfaces of the case due to gravity.

In addition, another effect is that the bottom surface of the case is inclined downward to a water collection part, whereby water guided from the top surface and the lateral surfaces of the case can effectively flow to the water collection part.

In addition, another effect is that an opening and closing valve is disposed in a discharge port, whereby water can be easily discharged from the case.

In addition, another effect is that the discharge port is hermetically sealed by the opening and closing valve due to external force of an elastic spring at a normal time, whereby the interior of the case is maintained in a low vacuum state and, when the drawer is opened, the opening and closing valve is automatically opened to discharge water formed in the case to the outside.

In addition, another effect is that in a case in which the drawer is closed and, therefore, the interior of the case is in a low vacuum state, two tight contact lips come into tight contact with each other, whereby the low vacuum state of the interior of the case is prevented from being released as the result of the introduction of external air into the case and, in a case in which the drawer is opened and, therefore, the low vacuum state of the interior of the case is released, the two tight contact lips become spaced apart from each other, whereby water formed in the case can be discharged out of the case.

In addition, another effect is that the opening and closing valve is disposed adjacent to the opening of the case, whereby the opening and closing valve cannot be observed by the naked eye unless the drawer is completely separated from the case and thus the aesthetical appearance is improved.

In addition, another effect is that water formed in the case can be discharged to the outside through simple opening and closing of the drawer based on a simple structure without additional control.

In addition, another effect is that mountain parts and valley parts are alternately arranged from the front to the rear of the case, whereby a user located in front of the case cannot see the dew stored in the valley parts.

In addition, another effect is that the mountain parts are formed in a right-angled triangular shape in a state in which an interior angle of each of the valley parts is decreased while the height of each of the mountain parts is not excessively increased to improve adhesive force between water and the valley parts.

In addition, another effect is that an inner case having guide channels defined therein is detachably coupled to the top surface and/or the bottom surface of the case, whereby application to a general vegetable container can be easily achieved.

It will be appreciated by those skilled in the art that the effects that can be achieved are not limited to what has been particularly described hereinabove and other advantages will be more clearly understood from the accompanying claims.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vegetable container for a refrigerator, comprising:

a case having an opening formed at a front thereof, the case being provided with a receiving space to receive objects to be stored;

a drawer to seal an interior of the case;

a discharge port formed through a bottom surface of the case to discharge water from the case;

a negative pressure part to lower pressure in the case; and an opening and closing valve to open and close the discharge port, wherein the opening and closing valve is closed by a difference in pressure between an inside and an outside of the case and is opened when the difference in pressure between the inside and the outside of the case is released, wherein the opening and closing valve comprises:

a fixing part having a space, through which water is collected, the fixing part being disposed in the discharge port; and at least two contact lips disposed at a lower part of the fixing part and come into contact with each other when there is a difference in pressure between the inside and the outside of the case, wherein the contact lips come into contact with each other to close the opening and closing valve when the pressure inside the case is lower than the pressure outside the case, and the contact lips become spaced apart from each other to open the opening and closing valve when the difference in pressure between the inside and the outside of the case is released.

2. The vegetable container according to claim 1, wherein the discharge port comprises:

a water collection part depressed in a portion of the bottom surface of the case; and a discharge part to allow the water collection part to communicate with an outside of the case.

3. The vegetable container according to claim 1, wherein the fixing part comprises:

a catching protrusion caught by the discharge port; and a distance maintaining part connected to the contact lips to maintain a distance between the contact lips.

4. The vegetable container according to claim 3, wherein the distance maintaining part has at least two inclined surfaces, a distance between the at least two inclined surfaces which is gradually decreased from the catching protrusion to the contact lips.

5. The vegetable container according to claim 4, wherein the contact lips are disposed at lower ends of the inclined surfaces, and the contact lips come into surface contact with each other.

6. The vegetable container according to claim 1, further comprising:

a guide channel formed at an inner surface of the case to guide water formed in the case to the discharge port, wherein the guide channel comprises:

at least two mountain parts protruding toward an inside of the case; and at least one valley part disposed between the respective mountain parts, the valley part being depressed toward an outside of the case.

7. The vegetable container according to claim 6, wherein the mountain parts and the valley part are alternately arranged from the front to a rear of the case.

8. The vegetable container according to claim 7, wherein each of the mountain parts comprises a base and a first inclined side and a second inclined side extending from opposite ends of the base to form an apex, and a length ratio of the base, the first inclined side, and the second inclined side of each of the mountain parts is 1.4 to 1.6 : 1.9 to 2.1 : 2.36 to 2.64.

9. The vegetable container according to claim 1, further comprising:

a top inner case disposed at an inside of an upper surface of the case, the top inner case being disposed between lateral surfaces of the case; and a top inner guide channel formed at an inner surface of the top inner case to guide water formed in the case to the discharge port, wherein the top inner guide channel comprises:

at least two mountain parts protruding toward an inside of the case; and at least one valley part disposed between the respective mountain parts, the valley part being depressed toward an outside of the case, the mountain parts and the valley part being alternately arranged from the front to a rear of the case.

10. The vegetable container according to claim 9, wherein the top inner case comprises:

a middle part located at a middle thereof;

two inclined parts extending from the middle part to the lateral surfaces of the case while being inclined downward; and edge parts bent downward from the inclined parts such that the edge parts come into contact with the lateral surfaces of the case by elastic force.

11. The vegetable container according to claim 1, further comprising:

a bottom inner case disposed at an inside of a lower surface of the case, the bottom inner case being disposed between lateral surfaces of the case; and a bottom inner guide channel formed at an inner surface of the bottom inner case to guide water formed in the case to the discharge port, wherein the bottom inner guide channel comprises:

at least two mountain parts protruding toward an inside of the case; and at least one valley part disposed between the respective mountain parts, the valley part being depressed toward an outside of the case, the mountain parts and the valley part being alternately arranged from the front to a rear of the case.

12. A refrigerator comprising:

a main body having a storage compartment;

a cooling device to cool the storage compartment;

a door to open and close the storage compartment; and a vegetable container mounted in the storage compartment of the main body, wherein the vegetable container comprises:

a case having an opening formed at a front thereof, the case being provided with a receiving space to receive objects to be stored;

a drawer to seal an interior of the case;

a discharge port formed through a bottom surface of the case to discharge water from the case; and an opening and closing valve to open and close the discharge port, wherein the opening and closing valve is closed by a difference in pressure between an inside and an outside of the case and is opened when the difference in pressure between the inside and the outside of the case is released, wherein the opening and closing valve comprises:

a fixing part having a space, through which water is collected, the fixing part being disposed in the discharge port; and at least two contact lips disposed at a lower part of the fixing part and come into contact with each other when there is a difference in pressure between the inside and the outside of the case, wherein the contact lips come into contact with each other to close the opening and closing valve when the pressure inside the case is lower than the pressure outside the case, and the contact lips become spaced apart from each other to open the opening and closing valve when the difference in pressure between the inside and the outside of the case is released.

* * * * *